US007695886B2

(12) United States Patent
Matsumura et al.

(10) Patent No.: US 7,695,886 B2
(45) **Date of Patent: *Apr. 13, 2010**

(54) PROCESS FOR PRODUCING RESIN PARTICLE LIQUID DISPERSION FOR ELECTROSTATIC IMAGE DEVELOPING TONER, ELECTROSTATIC IMAGE DEVELOPING TONER AND PRODUCTION PROCESS THEREOF

(75) Inventors: Yasuo Matsumura, Kanagawa (JP); Hirotaka Matsuoka, Kanagawa (JP); Satoshi Hiraoka, Kanagawa (JP); Yuki Sasaki, Kanagawa (JP); Fumiaki Mera, Kanagawa (JP); Hideo Maehata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1237 days.

This patent is subject to a terminal disclaimer.

(21) Appl. No.: 11/230,529

(22) Filed: Sep. 21, 2005

(65) Prior Publication Data

US 2006/0263709 A1 Nov. 23, 2006

(30) Foreign Application Priority Data

May 19, 2005 (JP) ..... 2005-146290
May 19, 2005 (JP) ..... 2005-146292

(51) Int. Cl.
*G03G 9/087* (2006.01)

(52) U.S. Cl. ..... 430/137.14; 430/137.15; 523/223

(58) Field of Classification Search ..... 430/137.14, 430/137.15; 523/223
See application file for complete search history.

(56) References Cited

U.S. PATENT DOCUMENTS

| | | | | |
|---|---|---|---|---|
| 7,498,113 | B2 * | 3/2009 | Matsumura et al. | 430/109.4 |
| 2005/0142478 | A1 * | 6/2005 | Matsumura et al. | 430/124 |
| 2005/0271965 | A1 * | 12/2005 | Kamiyoshi et al. | 430/111.4 |

FOREIGN PATENT DOCUMENTS

| | | |
|---|---|---|
| JP | A 63-282752 | 11/1988 |
| JP | A 6-250439 | 9/1994 |
| JP | A 2002-351140 | 12/2002 |

* cited by examiner

*Primary Examiner*—Janis L Dote
(74) *Attorney, Agent, or Firm*—Oliff & Berridge, PLC

(57) ABSTRACT

A process for producing a resin particle liquid dispersion for an electrostatic image developing toner, the process comprising: polycondensing a polycondensable monomer by utilizing an acid having a surface activating effect as a polycondensation catalyst, so as to obtain a polycondensed resin; and dispersing the polycondensed resin in an aqueous medium to which a base is added, so as to obtain a resin particle liquid dispersion in which a median diameter of resin particles is from 0.05 to 2.0 μm, or the process comprising: polycondensing a polycondensable monomer by utilizing an acid having a surface activating effect as a polycondensation catalyst in a co-presence of a polycondensed resin, so as to obtain a polycondensed resin-containing material; and dispersing the polycondensed resin-containing material in an aqueous medium, so as to obtain a resin particle liquid dispersion in which a median diameter of resin particles is from 0.05 to 2.0 μm.

12 Claims, No Drawings

PROCESS FOR PRODUCING RESIN PARTICLE LIQUID DISPERSION FOR ELECTROSTATIC IMAGE DEVELOPING TONER, ELECTROSTATIC IMAGE DEVELOPING TONER AND PRODUCTION PROCESS THEREOF

BACKGROUND OF THE INVENTION

1. Field of the Invention

The present invention relates to an electrostatic image developing toner for use in developing an electrostatic latent image formed by an electrophotographic method or an electrostatic recording method, with a developer; a production process thereof; and a production process of a resin particle liquid dispersion used as a raw material of the toner.

2. Description of the Related Art

At present, a method of visualizing image information through an electrostatic image by an electrophotographic process is being utilized in various fields. In the electrophotographic process, an electrostatic image is formed on a photoreceptor through electrostatic charging and exposure steps, and the electrostatic latent image is developed with a developer containing a toner and then visualized through transfer and fixing steps. The developer used here includes a two-component developer comprising a toner and a carrier, and a one-component developer using a magnetic toner or a non-magnetic toner solely. The toner is generally produced by a kneading and pulverizing production process where a thermoplastic resin is melt-kneaded with a pigment, an electrostatic charge controlling agent and a releasing agent such as wax and after cooling, the kneaded material is finely pulverized and then classified. In such a toner, an inorganic or organic particle is sometimes added to the toner particle surface, if desired, so as to improve flowability or cleaning property.

In recent years, a duplicator, a printer and a complex machine thereof with a facsimile, each employing a color electrophotographic process, are greatly spread. In the case of realizing appropriate gloss in the reproduction of a color image or transparency for obtaining an excellent OHP image, it is generally difficult to use a releasing agent such as wax. Accordingly, a large amount of an oil is applied to a fixing roll so as to assist separation but this causes tacky touch of a duplicated image including an OHP image, makes it difficult to write on the image with a pen or often gives feeling of heterogeneous gloss. In the case of an ordinary black-and-white copy, it is more difficult to use a wax generally employed, such as polyethylene, polypropylene and paraffin, because the OHP transparency is impaired.

Even if, for example, transparency is sacrificed, the wax can be hardly prevented from being exposed to the surface in the conventional production process for toner by a kneading and pulverizing method. As a result, when the toner is used as a developer, there arises a problem such as considerable deterioration in flowability or filming on the developing machine or photoreceptor.

As an ultimate method for overcoming these problems, a production process by a polymerization method is proposed, where an oil phase comprising monomers, which work out to the raw material of a resin, and a colorant is dispersed in an aqueous phase and then directly polymerized to form a toner, thereby enclosing the wax inside the toner and preventing the wax from being exposed to the surface.

Other than this, as a technique of intentionally controlling the shape and surface structure of the toner, a process of producing a toner by an emulsion polymerization and aggregation method is proposed in JP-A-63-282752 (the term "JP-A" as used herein means an "unexamined published Japanese patent application") and JP-A-6-250439. This is a production process where a resin particle liquid dispersion is produced generally by emulsion polymerization or the like, a colorant liquid dispersion is separately produced by dispersing a colorant in a solvent, these liquid dispersions are mixed to form an aggregate having a diameter corresponding to the particle diameter of a toner, and the aggregate particles are fused and coalesced under heating to form a toner.

In such a production process, not only internal inclusion of wax is realized but also reduction in the toner diameter is facilitated and reproduction of a clear image with high resolution is enabled.

In the above-described production process, in order to provide a high-quality image and stably maintain the performance of the toner under various mechanical stresses, it is very important to select the pigment and releasing agent, optimize the amounts thereof, prevent the releasing agent from being exposed to the surface, optimize the resin properties to improve the gloss and releasability without a fixing oil, and suppress the hot offset.

On the other hand, a technique enabling fixing at a lower temperature is demanded to reduce the consumed energy amount and in recent years, it is demanded to stop energizing the fixing machine except for operation so as to attain thorough energy saving. Therefore, the temperature of the fixing machine must be instantaneously elevated to the working temperature upon energization. For this purpose, the heat capacity of the fixing machine is preferably made as small as possible but if the case is so, the fluctuation width of the temperature of the fixing machine tends to be larger than ever. That is, the overshoot of the temperature after start of energization is increased, and the temperature drop due to passing of paper is also increased. Furthermore, when paper in a width smaller than the width of the fixing machine is continuously passed, the temperature difference between the paper passing part and the paper non-passing part becomes large. Particularly, in the case where the fixing machine is used in a high-speed duplicator or printer, such a phenomenon is more liable to occur because the capacity of the power source tends to run short. Therefore, an electrophotographic toner capable of being fixed at a low temperature and broadened in the so-called fixing latitude, that is, free from generation of offset until a high temperature region, is strongly demanded.

As for the technique of decreasing the fixing temperature of the toner, a method where a polycondensation-type crystalline resin showing a sharp melting behavior with respect to the temperature is used as the binder resin constituting the toner is known but in many cases, the crystalline resin cannot be generally used because this resin is difficult to pulverize by a melt-kneading pulverization method.

Also, for the polymerization of a polycondensation-type resin, the reaction must be performed for a long time of 10 hours or more at a high temperature exceeding 200° C. under highly reduced pressure while stirring by a large force, and a large amount of energy is consumed. Therefore, a huge equipment investment is often required for obtaining durability of the reaction equipment.

In the case of producing a toner by an emulsion polymerization and aggregation method as described above, the polycondensation-type crystalline resin polymerized may be emulsified in an aqueous medium to form a latex, aggregated in this state with a pigment, a wax and the like, and then fused and coalesced.

However, the emulsification of the polycondensed resin requires an extremely inefficient and highly energy-consuming step, for example, a step of emulsifying the resin under high shearing at a high temperature exceeding 150° C. or a step of dissolving the resin in a solvent to attain a low viscosity, dispersing the solution in an aqueous medium and then removing the solvent.

Also, the emulsification in an aqueous medium can hardly evade a problem such as hydrolysis, and the design of materials inevitably encounters generation of uncertain factors.

These problems are prominent in a crystalline resin but not limited to a crystalline resin and the same also occurs in the case of a non-crystalline resin.

For example, JP-A-2002-351140 proposes a method for producing a toner for electrostatic image development, wherein a toner raw material containing at least a polyester resin is heated and melted to produce a melt of the toner raw material, the melt is emulsified in an aqueous medium to form resin particles, and the resin particles are aggregated and further coalesced to produce an aggregate of the resin particles.

This method uses a process where using a conventional polycondensation catalyst such as tetrabutyl titanate and using monomers, for example, trimellitic anhydride (TMA) as the polyvalent carboxylic acid, terephthalic acid (TPA) and isophthalic acid (IPA) as the divalent carboxylic acid, polyoxypropylene(2,4)-2,2-bis(4-hydroxyphenyl)propane (BPA-PO) and polyoxyethylene(2,4)-2,2-bis(4-hydroxyphenyl) propane (BPA-EO) as the aromatic diol, and ethylene glycol (EG) as the aliphatic diol, a reaction is performed at 220° C. for 15 hours in a nitrogen stream under atmospheric pressure, the pressure is gradually decreased, a reaction is performed at 10 mmHg to produce a polyester having a weight average molecular weight of about 5,000 to 90,000, the polyester is melt-kneaded with a colorant, a wax and the like, the melt-kneaded product MB 1 is heated to 190° C. and charged into CAVITRON CD1010 (manufactured by Eurotec, Ltd.), 0.5 wt % of dilute ammonia water is added, MB1 is fed to CAVITRON at a rate of 1 L/min under heating at 160° C. by a heat exchanger, and the liquid dispersion slurry obtained after dispersion is cooled to 60° C. and taken out.

For forming a toner, this liquid dispersion is further subjected to aggregation, coalescence, washing and drying. However, such a process apparently requires huge energy at the production and emulsification of the resin and is considered to be unusable in practice.

Furthermore, the emulsification dispersion under such a high energy condition readily incurs decomposition of the resin and causes a problem such as occurrence of uneven distribution of the composition or difficulty in realizing a uniform particle size distribution of resin particles in the liquid dispersion. The toner using such a material readily brings about a problem in the stability of image quality at continuous printing as well as the initial image quality.

SUMMARY OF THE INVENTION

Accordingly, in the present invention, those various problems in related techniques are solved. That is, the present invention provides a resin particle liquid dispersion for an electrostatic image developing toner, in which resin particles are stably emulsified and dispersed with low energy in an aqueous medium. Another the present invention further provides an electrostatic image developing toner using the resin particle liquid dispersion, which is fully satisfied in the toner properties and ensures no change in the performance over a long period of time. The present invention includes providing a production process of the toner, an electrostatic image developer and an image forming method using these.

These are attained by the following means.

A process for producing a resin particle liquid dispersion for an electrostatic image developing toner, the process comprising:

polycondensing a polycondensable monomer by utilizing an acid having a surface activating effect as a polycondensation catalyst, so as to obtain a polycondensed resin; and dispersing the polycondensed resin in an aqueous medium to which a base is added, so as to obtain a resin particle liquid dispersion in which a median diameter of resin particles is from 0.05 to 2.0 μm. And, A process for producing a resin particle liquid dispersion for an electrostatic image developing toner, the process comprising:

polycondensing a polycondensable monomer by utilizing an acid having a surface activating effect as a polycondensation catalyst in a co-presence of a polycondensed resin, so as to obtain a polycondensed resin-containing material; and dispersing the polycondensed resin-containing material in an aqueous medium, so as to obtain a resin particle liquid dispersion in which a median diameter of resin particles is from 0.05 to 2.0 μm.

DETAILED DESCRIPTION OF THE INVENTION

The present invention is described in detail below.

(Production Process of Liquid Dispersion for Electrostatic Image Developing Toner)

The process for producing a resin particle liquid dispersion for an electrostatic image developing toner of the first embodiment of the present invention (hereinafter sometimes simply referred to as a "resin particle liquid dispersion of the present invention") is characterized by comprising a step of polycondensing polycondensable monomers by using an acid having a surface activating effect as the polycondensation catalyst to obtain a polycondensed resin, and a step of dispersing said polycondensed resin in an aqueous medium having added thereto a base, to obtain a resin particle liquid dispersion in which the median diameter of the resin particle is from 0.05 to 2.0 μm.

In the present invention, the base added to the aqueous medium in which resin particles are dispersed may be sufficient if it neutralizes the acidity of the liquid dispersion, but examples thereof include an inorganic base such as inorganic hydroxide, inorganic carbonate and ammonia, and an organic base such as amine. Among these, in view of cost and solubility in the aqueous medium, an inorganic hydroxide is preferred, and sodium hydroxide is more preferred.

When the base is added to the aqueous medium, a part or the entirety of the acid having a surface activating effect is neutralized to produce a salt of the acid having a surface activating effect. The salt of the acid having a surface activating effect may be in a state of being dissolved or precipitated in the aqueous medium.

The amount of the base added varies depending on, for example, solubility in the aqueous medium or pKa of the base but is preferably an amount of keeping the liquid dispersion in the region from weakly acidic to neutral (pH=4 to 8) and is preferably from 0.01 to 2 equivalent, more preferably from 0.05 to 1 equivalent, still more preferably from 0.1 to 0.8 equivalent, based on one equivalent of the acid having a surface activating effect.

Examples of the aqueous medium usable in the present invention include water such as distilled water and ion exchanged water, and an alcohol. Among these, water such as distilled water and ion exchanged water is preferred. One of these may be used alone or two or more thereof may be used in combination.

The pH of the resin particle liquid dispersion of the present invention is preferably from 4.0 to 8.0, more preferably from 5.0 to 8.0, still more preferably from 6.0 to 8.0.

The process for producing a resin particle liquid dispersion for an electrostatic image developing toner of the second embodiment of the present invention (hereinafter sometimes simply referred to as a "resin particle liquid dispersion of the present invention") is characterized by comprising a step of polycondensing polycondensable monomers by using an acid having a surface activating effect as the polycondensation catalyst in the co-presence of a polycondensed resin to obtain a polycondensed resin-containing material, and a step of dispersing the polycondensed resin-containing material in an aqueous medium to obtain a resin particle liquid dispersion in which the median diameter of the resin particle is from 0.05 to 2.0 μm.

The polycondensed resin caused to be present together at the polycondensation (hereinafter sometimes referred to as a "co-present polycondensed resin") may be a crystalline resin or a non-crystalline resin. In the case where the polycondensed resin caused to be present together is a crystalline resin, the resin obtained from polycondensable monomers is preferably a non-crystalline resin, whereas in the case where the polycondensed resin caused to be present together is a non-crystalline resin, the resin obtained from polycondensable monomers is preferably a crystalline resin.

With such a combination, good particle size distribution is obtained at the aggregation, the distribution of respective resin particles in the inside or on the surface of the toner can be controlled, and good low-temperature fixability, high reliability in long-term use and excellent electrostatic property in aging are advantageously realized.

In related methods, the crystalline polycondensed resin is effective for realizing low-temperature fixing because this resin shows a sharp melting behavior with respect to the temperature but on the other hand, the non-crystalline resin sometimes surpasses the crystalline resin in view of mechanical strength and electrostatic retention as the toner in long-term use. Therefore, it becomes important to satisfy both the low-temperature fixability and the reliability in long-term use by not using only a crystalline resin alone but also disposing a non-crystalline resin on the surface or in the inside of the toner. In this case, a method of separately preparing a crystalline resin particle liquid dispersion and a non-crystalline resin particle liquid dispersion, and forming a toner through mixing, aggregation and coalescence in water is generally employed. However, since these two kinds of resin particles greatly differ in the heat-melting property, the adhesive force between particles may not be uniform and this may worsen the particle size distribution at the aggregation, or even if a toner is successfully formed, the intended distribution of respective resin particles in the inside or on the surface of the toner may not be obtained and the low-temperature fixability or the electrostatic property in aging may be unsatisfied.

Accordingly, a preferred embodiment of the production process of a resin particle liquid dispersion for an electrostatic image developing toner of the present invention is as follows.

That is, a process for producing a resin particle liquid dispersion for an electrostatic image developing toner, comprising a step of polycondensing polycondensable monomers of giving a non-crystalline polycondensed resin, by using an acid having a surface activating effect as the polycondensation catalyst in the co-presence of a crystalline polycondensed resin to obtain a crystalline polycondensed resin and non-crystalline polycondensed resin-containing material, or a step of polycondensing polycondensable monomers of giving a crystalline polycondensed resin, by using an acid having a surface activating effect as the polycondensation catalyst in the co-presence of a non-crystalline polycondensed resin to obtain a crystalline polycondensed resin and non-crystalline polycondensed resin-containing material, and a step of dispersing the polycondensed resin-containing material in an aqueous medium to obtain a resin particle liquid dispersion in which the median diameter of the resin particle is from 0.05 to 2.0 μm, is preferred.

In such a resin particle liquid dispersion of the present invention, the polycondensable monomers are polycondesed at a low temperature (preferably 150° C. or less, more preferably from 70 to 150° C., still more preferably from 70 to 140° C.) in the co-presence of a co-present polycondensed resin and emulsification-dispersed at a low temperature (preferably 150° C. or less, more preferably from 70 to 150° C., still more preferably from 70 to 90° C.), so that the polycondensed resin particle can be obtained with low energy, the dispersion state of the polycondensed resin particle in an aqueous medium can be an isolated state in water, the stable state can last for a long time until performing an aggregation operation with use of a coagulant for forming a toner, aggregate particles can be formed with high controllability for the first time by an aggregation operation and therefore, when a toner is formed by using this liquid dispersion, a toner fully satisfied in the toner properties can be obtained by virtue of good particle size distribution as the toner and uniformized composition and structure among individual toners.

As a result, the image quality at continuous printing as well as the initial image quality can stably maintain a high image quality.

The median diameter (center diameter) of the polycondensed resin particle is from 0.05 to 2.0 μm, preferably from 0.1 to 1.5 μm, more preferably from 0.1 to 1.0 μm, still more preferably from 0.1 to 0.3 μm. With a median diameter in this range, the dispersion state of polycondensed resin particles in an aqueous medium is stabilized as described above. In the production of a toner, if this median diameter is too small, the aggregating property at the formation of particles is worsened, isolated resin particles are readily generated, or the viscosity of the system tends to increase, making it difficult to control the particle diameter. On the other hand, if the median diameter is excessively large, generation of coarse powder readily occurs to worsen the particle size distribution and at the same time, the releasing agent such as wax tends to be isolated, giving rise to reduction in the releasability at the fixing or lowering of the offset-generating temperature.

The median diameter of the polycondensed resin particle can be measured, for example, by a laser diffraction-type particle size distribution measuring device (LA-920, Manufactured by Horiba Ltd.).

The polycondensed resin particle is preferably free from generation of ultrafine powder or ultra-coarse powder and therefore, not only its median diameter is in the above-described range but only the ratio of the polycondensed resin particle having a particle diameter of 0.03 μm or less or a particle diameter of 5.0 μm or more (hereinafter sometimes referred to as a "large/small particle overall ratio") is preferably 10% or less, more preferably 5% or less, based on the entire polycondensed resin particle. This ratio can be obtained by plotting the relationship between the particle diameter and the frequency integration based on the measurement results by LA-920 and determined from the accumulated frequency of 0.03 μm or less or 5.0 μm or more.

For obtaining the resin particle liquid dispersion of the present invention, polycondensable monomers as the raw material of the objective resin and an acid having a surface activating effect are melt-mixed, heated, stirred and held under atmospheric or reduced pressure to obtain a polymer, and the polymer in the heated state is mixed with hot water and emulsification-dispersed by a homogenizer or the like, whereby the resin particle liquid dispersion is obtained. The heating temperature at the polycondensation is preferably 150° C. or less, more preferably from 70 to 150° C., still more preferably from 70 to 140° C. Within this range, decomposition of the polycondensed resin or uneven distribution of its composition does not occur or when a resin particle liquid dispersion is obtained, the particle size distribution of resin particles becomes uniform and this is preferred.

At this time, if desired, another polycondensation catalyst, a surfactant or the like can be used in combination. Also, a base for neutralizing an acid having a surface activating effect, which is the polycondensation catalyst, may be added to the aqueous medium used at the dispersion of the resin.

The acid having a surface activating effect acts as a polycondensation catalyst of exerting the effect at a low temperature (preferably 150° C. or less, more preferably from 70 to 150° C., still more preferably from 70 to 140° C.) at the time of polymerizing the resin. Also, the acid having a surface activating effect and/or a salt thereof acts as a dispersant uniformly mixed in the resin at the dispersion and emulsification in water, and emulsification at a low temperature (preferably 150° C. or less, more preferably from 70 to 150° C., still more preferably from 70 to 90° C.) can be realized.

Conventionally, it has been known in many cases to add a dispersant to the water side at the dispersion and emulsification of a resin in water, but in such a case, the dispersant can hardly act on the emulsification unless a high temperature of causing reduction in the viscosity of the resin is imparted, and emulsification at a low temperature cannot be realized.

If the resin is made self-dispersible in water, for example, by adding an acid value as described in JP-A-2002-351140 so as to elevate the emulsifiability of the resin, this brings about reduction in the electrostatic property or great change in the toner chargeability under the high-temperature high-humidity and low-temperature low-humidity conditions when the resin is finally used as a toner and therefore, is not practical.

The acid having a surface activating effect used here is a relatively low molecular acid with high water solubility and is mostly removed at the washing after aggregation coalescence for the formation of a toner and therefore, the effect on the toner chargeability can be minimized.

The temperature at the emulsification and dispersion is preferably 150° C. or less, more preferably 100° C. or less, still more preferably 90° C. or less. Within this range, hydrolysis of the polycondensed resin does not occur and also, chargeability, fixability or the alike of the toner is advantageously good.

When shearing is applied at a high temperature, this is liable to cause hydrolysis of the polycondensed resin or bring about a problem in the chargeability, fixability or the like of the toner, but the dispersion emulsification at a low temperature can also inhibit occurrence of these troubles.

In order to polycondense polycondensable monomers at a low temperature of 150° C. or less, preferably 100° C. or less, a polycondensation catalyst is usually used. As for the polycondensation catalyst having a catalytic activity at such a low temperature, an acid having a surface activating effect is used, but a rare earth-containing catalyst, a hydrolase or the like may also be used in combination.

The acid having a surface activating effect is a catalyst having a chemical structure comprising a hydrophobic group and a hydrophilic group, in which at least a part of the hydrophilic group comprises a proton, and this acid is a catalyst having both an emulsification function and a catalytic function. Examples of the acid having a surface activating effect include an alkylbenzenesulfonic acid, an alkylsulfonic acid, an alkyldisulfonic acid, an alkylphenolsulfonic acid, an alkylnaphthalenesulfonic acid, an alkyltetralinesulfonic acid, an alkylallylsulfonic acid, a petroleum sulfonic acid, an alkylbenzimidazole sulfonic acid, a higher alcohol ether sulfonic acid, an alkyldiphenylsulfonic acid, a long-chain alkylsulfuric acid ester, a higher alcohol sulfuric acid ester, a higher alcohol ether sulfuric acid ester, a higher fatty acid amidealkylol sulfuric acid ester, a higher fatty acid amidoalkylated sulfuric acid ester, a sulfated fat, a sulfosuccinic acid ester, various acids, a sulfonated higher fatty acid, a higher alkylphosphoric acid ester, a resin acid, a resin acid alcohol, and salt compounds of all of these acids. If desired, plural species thereof may be used in combination. Among these, preferred are a sulfonic acid having an alkyl group or an aralkyl group, a sulfuric acid ester having an alkyl group or an aralkyl group, and salt compounds thereof, and more preferred are those in which the carbon number of the alkyl group or aralkyl group is from 7 to 20. Specific examples thereof include dodecylbenzenesulfonic acid, isopropylbenzenesulfonic acid, kerylbenzenesulfonic acid, comphorsulfonic acid, para-toluenesulfonic acid, monobutyl-phenylphenol sulfuric acid, dibutyl-phenylphenol sulfuric acid, dodecylsulfuric acid, naphthenyl alcohol sulfuric acid and naphthenic acid.

The amount used of the acid having a surface activating effect usable in the present invention is preferably from 0.01 to 5 wt %, more preferably from 0.1 to 3 wt %, based on the total weight of polycondensable monomers.

As for the rare earth-containing catalyst which can be used in combination, those containing an element such as scandium (Sc), yttrium (Y), lanthanum (La) as lanthanoid element, cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) or lutetium (Lu) are effective, and those having an alkylbenzenesulfonate, alkylsulfuric ester salt or triflate structure are more effective. As for the triflate, the structural formula thereof includes $X(OSO_2CF_3)_3$, wherein X is a rare earth element, preferably scandium (Sc), yttrium (Y), ytterbium (Yb) or samarium (Sm).

The lanthanoid triflate is described in detail, for example, in Journal of Synthetic Organic Chemistry, Japan, Vol. 53, No. 5, pp. 44-54.

The hydrolase used in combination is not particularly limited as long as it catalyzes an ester synthetic reaction. Examples of the hydrolase include esterases classified into EC (enzyme code) group 3.1 (see, for example, Maruo and Tamiya (supervisors), Koso Handbook (Handbook of Enzyme), Asakura Shoten (1982)) such as carboxyesterase, lipase, phospholipase, acetylesterase, pectinesterase, cholesterol esterase, tannase, monoacylglycerol lipase, lactonase and lipoprotein lipase; hydrolases classified into EC group 3.2 having activity on a glycosyl compound, such as glucosidase, galactosidase, glycuronidase and xylosidase; hydrolases classified into EC group 3.3 such as epoxide hydrase; hydrolases classified into EC group 3.4 having activity on a peptide bond, such as aminopeptidase, chymotrypsin, trypsin, plasmin and subtilisin; and hydrolases classified into EC group 3.7 such as phloretin hydrase.

Among those esterases, an enzyme of hydrolyzing a glycerol ester and isolating a fatty acid is called a lipase. The lipase is advantageous in that this enzyme shows high stability in an organic solvent, catalyses an ester synthesis reaction with good efficiency and is inexpensive. Accordingly, from the aspect of yield and cost, a lipase is preferably used also in the production process of a polyester of the present invention.

Lipases of various origins may be used but preferred examples thereof include a lipase obtained from microorganisms of *Pseudomonas* group, *Alcaligenes* group, *Achromobacter* group, *Candida* group, *Aspergillus* group, *Rizopus* group, *Mucor* group and the like, a lipase obtained from plant seeds and a lipase obtained from animal tissues and further include pancreatin and steapsin. Among these, preferred is a lipase originated in microorganisms of *Pseudomonas* group, *Candida* group and *Aspergillus* group.

These polycondensation catalysts may be used individually or in combination. of multiple species. The amount of the polycondensation catalyst used is preferably from 0.01 to 15 wt %, more preferably from 0.1 to 10 wt %, based on the total weight of polycondensable monomers.

Examples of the polycondensation monomer include a polyvalent carboxylic acid, a polyol and a polyamine, Examples of the polycondensed resin include a polyester and a polyamide. In particular, a polyester obtained by using a polyvalent carboxylic acid and a polyol as the polycondensation monomers is preferred.

The polycarboxylic acid is a compound having two or more carboxyl group within one molecule. Out of these compounds, a dicarboxylic acid is a compound having two carboxyl group within one molecule and examples thereof include an oxalic acid, a succinic acid, a maleic acid, an adipic acid, a β-methyladipic acid, an azelaic acid, a sebacic acid, a nonanedicarboxylic acid, a decanedicarboxylic acid, an undecanedicarboxylic acid, a dodecanedicarboxylic acid, a fumaric acid, a citraconic acid, a diglycolic acid, a cyclohexane-3,5-diene-1,2-carboxylic acid, a malic acid, a citric acid, a hexahydroterephthalic acid, a malonic acid, a pimelic acid, a tartaric acid, a mucic acid, a phthalic acid, an isophthalic acid, a terephthalic acid, a tetrachlorophthalic acid, a chlorophthalic acid, a nitrophthalic acid, a p-carboxyphenylacetic acid, a p-phenylenediacetic acid, an m-phenylenediglycolic acid, a p-phenylenediglycolic acid, an o-phenylenediglycolic acid, a diphenylacetic acid, a diphenyl-p,p'-dicarboxylic acid, a naphthalene-1,4-dicarboxylic acid, a naphthalene-1,5-dicarboxylic acid, a naphthalene-2,6-dicarboxylic acid and an anthracene dicarboxylic acid. Examples of the polyvalent carboxylic acid other than the dicarboxylic acid include a trimellitic acid, a trimesic acid, a pyromellitic acid, a naphthalenetricarboxylic acid, a naphthalenetetracarboxylic acid, a pyrenetricarboxylic acid and a pyrenetetracarboxylic acid.

In the case of performing the polycondensation reaction in an aqueous medium liquid dispersion, preferred among the polyvalent carboxylic acids are an azelaic acid, a sebacic acid, a 1,9-nonanedicarboxylic acid, a 1,10-decanedicarboxylic acid, a 1,11-undecanedicarboxylic acid, a 1,12-dodecanedicarboxylic acid, a terephthalic acid, a trimellitic acid and a pyromellitic acid. These polyvalent carboxylic acids are sparingly soluble or insoluble in water and therefore, the ester synthesis reaction proceeds in a suspension liquid where a polyvalent carboxylic acid is dispersed in water.

The polyol is a compound having two or more hydroxyl groups within one molecule. Out of these compounds, the diol is a compound having two hydroxyl groups within one molecule and examples thereof include ethylene glycol, propylene glycol, butanediol, diethylene glycol, hexanediol, cyclohexanediol, octanediol, nonanediol, decanediol and dodecanediol. Examples of the polyol other than the diol include glycerin, pentaerythritol, hexamethylolmelamine, hexaethylolmelamine, tetramethylolbenzoguanamine and tetraethylolbenzoguanamine.

Among these polyols, preferred are diols such as ethylene glycol, 1,4-butanediol, 1,6-hexanediol, 1,8-octanediol, 1,9-nonanediol, 1,10-decanediol and 1,12-dodecanediol.

In the case of performing the polycondensation reaction in an aqueous medium liquid dispersion, a divalent polyol such as 1,8-octanediol, 1,9-nonanediol, 1,10-decanediol and 1,12-dodecanediol is preferably used. These polyols are sparingly soluble or insoluble in water and therefore, the ester synthesis reaction proceeds in a suspension liquid where a polyol is dispersed in water.

By combining these polycondensable monomers, a non-crystalline resin or a crystalline resin can be easily obtained.

Examples of the polyvalent carboxylic acid used for obtaining a crystalline polyester or a crystalline polyamide include an oxalic acid, a malonic acid, a succinic acid, a glutaric acid, an adipic acid, a pimelic acid, a suberic acid, an azelaic acid, a sebacic acid, a maleic acid, a fumaric acid, a citraconic acid, an itaconic acid, a glutaconic acid, an n-dodecylsuccinic acid, an n-dodecenylsuccinic acid, an isododecylsuccinic acid, an isodecenylsuccinic acid, an n-octylsuccinic acid, an n-octenylsuccinic acid, a 1,9-nonanedicarboxylic acid, a 1,10-decanedicarboxylic acid, 1,11-undecanedicarboxylic acid, 1,12-dodecanedicarboxylic acid and an acid anhydride or acid chloride thereof Examples of the polyol used for obtaining a crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol, polypropylene glycol, polytetramethylene glycol, bisphenol A, bisphenol Z and hydrogenated bisphenol A.

Examples of the polyamine used for obtaining a polyamide include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine and 1,4-cyclohexanebis(methylamine).

Examples of the polyvalent carboxylic acid for obtaining a non-crystalline polyester include, but are not limited to an aromatic dicarboxylic acid such as dibasic acid (e.g., phthalic acid, isophthalic acid, terephthalic acid, naphthalene-2,6-dicarboxylic acid, malonic acid, mesaconic acid), and a lower ester thereof. Examples of the trivalent or higher polyvalent carboxylic acid include, but are not limited to, 1,2,4-benzenetricarboxylic acid (trimellitic acid), 1,3,5-benzenetricarboxylic acid (trimesic acid), 1,2,4-naphthalenetricarboxylic acid, pyromellitic acid, an anhydride thereof, sodium 2-sulfoterephthalate, sodium 5-sulfoisophthalate, sodium sulfosuccinate, and a lower ester thereof.

Preferred examples of the polyhydric alcohol for obtaining a non-crystalline polyester include an aliphatic, alicyclic or aromatic polyhydric alcohol and specific examples thereof include, but are not limited to, ethylene glycol, 1,5-pentane glycol, 1,6-hexane glycol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A, and an ethylene oxide or propylene oxide adduct of bisphenol A (e.g., polyoxypropylene(2,2)-2,2-bis(4-hydroxyphenyl)propane).

The polycondensed resin particle obtained by polycondensing such polycondensable monomers is preferably crystalline. In particular, when a crystalline resin is used, the low-temperature fixing of the toner can be easily realized.

Preferred examples of the crystalline polycondensed resin include a polyester obtained by reacting 1,9-nonanediol and 1,10-decanedicarboxylic acid, a polyester obtained by reacting cyclohexanediol and adipic acid, a polyester obtained by reacting 1,6-hexanediol and sebacic acid, a polyester obtained by reacting ethylene glycol and succinic acid, a polyester obtained by reacting ethylene glycol and sebacic acid, a polyester obtained by reacting 1,4-butanediol and succinic acid, and a polyester obtained by reacting 1,9-nonanediol and azelaic acid. Among these, more preferred are a polyester obtained by reacting 1,9-nonanediol and 1,10-decanedicarboxylic acid, and a polyester obtained by reacting 1,6-hexanediol and sebacic acid.

Preferred examples of the non-crystalline polycondensed resin include a polyester obtained by reacting ethylene glycol, polyoxyethylene(2.4)-2,2-bis(4-hydroxyphenyl)propane and terephthalic acid.

Also, the above-described ethylene oxide adduct or propylene oxide adduct of bisphenol A may be mixed, or a terephthalic acid and a fumaric acid may be used individually or in combination for the acid side.

In the case where the polycondensed resin particle is a crystalline resin, the crystalline melting point Tm is preferably from 50° C. to less than 120° C., more preferably from 55 to 90° C. When the Tm is in this range, the cohesive force of the binder resin itself is not decreased in the high-temperature region and good separability or high hot offset resistance is obtained at the fixing. Also, the lowest fixing temperature is not elevated and this is preferred.

Here, the melting point of the crystalline resin is measured by using a differential scanning calorimeter (DSC) and can be determined as a melt peak temperature of the input compensation differential scanning calorimetry prescribed in JIS K-7121 when the measurement is performed by elevating the temperature at a rate of 10° C./min from room temperature to 150° C. The crystalline resin sometimes shows a plurality of melt peaks but in the present invention, the maximum peak is designated as the melting point.

The glass transition point of the non-crystalline resin means a value measured by the method prescribed in ASTM D3418-82 (DSC method).

In the case where the polycondensed resin particle is a non-crystalline resin, the glass transition point Tg is preferably from 50° C. to less than 80° C., more preferably from 50 to 65° C. When the Tg is in this range, the cohesive force of the binder resin itself is not decreased in the high-temperature region and hot offset scarcely occurs at the fixing. Also, the lowest fixing temperature is not elevated and this is preferred.

The weight average molecular weight of the polycondensed resin particle obtained by polycondensing polycondensable monomers is suitably from 1,500 to 60,000, preferably from 3,000 to 40,000. Within this range, sufficiently high cohesive force of the binder resin and good hot offset resistance are obtained and the lowest fixing temperature is advantageously not elevated. Also, a part of the polycondensed resin may be caused to have a branched or crosslinked structure by selecting the carboxylic acid valence or alcohol valence of monomers.

At the time of dispersing and emulsifying the polycondensed resin in an aqueous medium, the above-described materials are emulsified or dispersed in an aqueous medium by using, for example, mechanical shear or ultrasonic wave and, if desired, a surfactant, a polymer dispersant or an inorganic dispersant may be added to the aqueous medium during the emulsification dispersion.

Examples of the surfactant used here include an anionic surfactant such as sulfuric ester salt type, sulfate type and phosphoric ester type; a cationic surfactant such as amine salt type and quaternary ammonium salt type; and a nonionic surfactant such as polyethylene glycol type, alkylphenol ethylene oxide adduct type and polyhydric alcohol type. Among these, an anionic surfactant and a cationic surfactant are preferred. The nonionic surfactant is preferably used in combination with the anionic surfactant or cationic surfactant. One of these surfactants may be used alone or two or more thereof may be used in combination.

Examples of the anionic surfactant include sodium dodecylbenzenesulfonate, sodium alkylnaphthalenesulfonate, sodium arylalkylpolyethersulfonate, sodium 3,3-disulfonediphenylurea-4,4-diazobisamino-8-naphthol-6-sulfonate, o-carboxybenzeneazodimethylaniline, sodium 2,2,5,5-tetramethyltriphenylmethane-4,4-diazobis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate, oleic acid and calcium.

Examples of the cationic surfactant include alkylbenzenedimethylammonium chloride, alkyltrimethylammonium chloride and distearylammonium chloride.

Examples of the nonionic surfactant include polyethylene oxide, polypropylene oxide, a combination of polypropylene oxide and polyethylene oxide, an ester of polyethylene glycol and higher fatty acid, alkylphenol polyethylene oxide, an ester of higher fatty acid and polyethylene glycol, an ester of higher fatty acid and polypropylene oxide, and sorbitan ester.

Examples of the polymer dispersant include sodium polycarboxylate and polyvinyl alcohol, and examples of the inorganic dispersant include calcium carbonate, but the present invention is in no way limited thereto.

Furthermore, a higher alcohol as represented by heptanol and octanol, or a higher aliphatic hydrocarbon as represented by hexadecane, which are usually often blended so as to prevent the Ostwald ripening phenomenon of the monomer emulsion particle in an aqueous medium, may also be added.

At the time of polycondensing the polycondensed resin particle in an aqueous medium, it is also possible that the components necessary for a normal toner, such as colorant, fixing aid (e.g., wax) and electrification aid, are previously mixed in the aqueous medium and incorporated into the polycondensed resin particle simultaneously with the polycondensation.

In the second embodiment of the present invention, examples of the polycondensed resin caused to be present together at the polycondensation of polycondensable monomers include a polyester and a polyamide. As described above, in the case where the resin obtained from polycondensable monomers is a non-crystalline resin, the polycondensed resin caused to be present together is preferably a crystalline resin and in the case where the resin obtained from polycondensable monomers is a crystalline resin, the polycondensed resin caused to be present together is preferably a non-crystalline resin.

Preferred examples of the polycondensed resin caused to be present together include a polycondensed resin obtained from the polycarboxylic acid, polyol and polyamine described above for the polycondensable monomer. Other preferred examples include a polyester obtained from a polyether polyol and a polyvalent carboxylic acid, and specific examples thereof include a polyester obtained by reacting polyoxypropylene(2.2)-2,2-bis(4-hydroxyphenyl)propane, polyoxyethylene(2.2)-2,2-bis(4-hydroxyphenyl)propane, fumaric acid, dimethyl terephthalate and adipic acid.

The polycondensed resin caused to be present together, which can be used in the present invention, is not limited in its production process and may be produced by a known method. For example, this resin may be produced by using the above-described acid having a surface activating effect as the polycondensation catalyst or may be produced by using an organic metal such as dibutyltin dilaurate and dibutyltin oxide or using an esterification catalyst such as metal alkoxide (e.g., tetrabutyl titanate).

In the second embodiment of the present invention, the base used in the first embodiment may be added to the aqueous medium. The examples and the amount of the base are the same as mentioned above.

(Production Process of Electrostatic Image Developing Toner)

The process for producing an electrostatic image developing toner of the present invention is a production process of an electrostatic image developing toner, comprising a step (aggregation step) of aggregating resin particles in a liquid dispersion containing at least a resin particle liquid dispersion to obtain aggregate particles, and a step (coalescence step) of heating and thereby coalescing the aggregate particles, wherein the resin particle liquid dispersion is a resin particle liquid dispersion for an electrostatic image developing toner obtained by the production process of a resin particle liquid dispersion for an electrostatic image developing toner of the present invention. This production process is hereinafter sometimes referred to as an emulsion polymerization and aggregation process.

The polycondensed resin particle in the resin particle liquid dispersion of the present invention is prepared in an aqueous medium and therefore, this resin particle liquid dispersion can be used as-is as the resin particle liquid dispersion in the aggregation step. If desired, the resin particle liquid dispersion is mixed with a colorant particle liquid dispersion and a releasing agent particle liquid dispersion, and the particles are hetero-aggregated by further adding a coagulant, whereby an aggregate particle having a toner size can be formed. Also, after forming a first aggregate particle by such aggregation, the resin particle liquid dispersion of the present invention or another resin particle liquid dispersion may be further added to form a second shell layer on the surface of the first aggregate particle. In this example, a colorant liquid dispersion is separately prepared, but when a colorant is previously blended in the polycondensed resin particle, the colorant liquid dispersion is not required.

As for the coagulant, a surfactant, an inorganic salt or a divalent or higher polyvalent metal salt can be suitably used. In particular, a metal salt is preferred in view of aggregation control and properties such as toner chargeability.

Also, a surfactant may be used, for example, in emulsion polymerization of resin, dispersion of pigment, dispersion of resin particle, dispersion of releasing gent, aggregation, or stabilization of aggregate particle. Specific examples of the surfactant include a cationic surfactant such as sulfuric ester salt type, sulfonate type, phosphoric ester type and soap type; and a cationic surfactant such as amine salt type and quaternary ammonium salt type. It is also effective to use a nonionic surfactant such as polyethylene glycol type, alkylphenol ethylene oxide adduct type and polyvalent alcohol type, in combination. As for the dispersing means, a generally employed device such as rotation shearing homogenizer and media-containing ball mill, sand mill or dynomill, may be used.

In addition to the resin particle liquid dispersion of the present invention, a conventionally known addition polymerization-type resin particle liquid dispersion produced by using emulsion polymerization may be used in combination. The resin particle in the addition polymerization-type resin particle liquid dispersion which can be used in the present invention preferably has a median diameter of 0.05 to 2.0 μm similarly to the resin particle liquid dispersion of the present invention.

Examples of the addition polymerization-type monomer for producing such a resin particle liquid dispersion include a vinyl-type monomer, for example, styrenes such as styrene and parachlorostyrene; vinyl ethers such as vinyl naphthalene, vinyl chloride, vinyl bromide, vinyl fluoride, vinyl acetate, vinyl propionate, vinyl benzoate and vinyl butyrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate and butyl methacrylate; acrylonitrile; methacrylonitrile; acrylamide; vinyl ethers such as vinyl methyl ether, vinyl ethyl ether and vinyl isobutyl ether; a monomer having an N-polar group, such as N-vinyl compound (e.g., N-vinylpyrrole, N-vinylcarbazole, N-vinylindole, N-vinylpyrrolidone); a methacrylic acid; an acrylic acid; a cinnamic acid; and vinyl carboxylic acids such as carboxyethyl acrylate. A homopolymer or copolymer of such a monomer may be used and in combination therewith, various waxes may also be used.

In the case of an addition polymerization-type monomer, a resin particle liquid dispersion can be produced by performing emulsion polymerization with use of an ionic surfactant or the like. In the case of other resins which dissolve in an oily solvent having a relatively low solubility in water, the resin is dissolved in the solvent and dispersed into particles in water together with an ionic surfactant or a polymer electrolyte by using a disperser such as homogenizer, and then the solvent is evaporated under heating or reduced pressure, whereby a resin particle liquid dispersion can be obtained.

At the polymerization of the addition polymerization-type monomer, a chain transfer agent may also be used. The chain transfer agent is not particularly limited but specifically, a chain transfer agent having a covalent bond of a carbon atom and a sulfur atom is preferred and, for example, thiols are preferred.

After passing through the aggregation step, the aggregate particles are fused and coalesced in the coalescence step (fusing-coalescence step) by heating them at a temperature higher than the glass transition point or melting point of the resin particle and then, if desired, washed and dried, whereby a toner can be obtained.

After the completion of the coalescence step, a washing step, a solid-liquid separation step and a drying step are arbitrarily performed to obtain a desired toner particle, but when the electrostatic property is taken account of, the washing step is preferably performed by thorough displacement washing with ion exchanged water. The solid-liquid separation step is not particularly limited, but in view of productivity, suction filtration, pressurization filtration and the like are preferred. The drying step is also not particularly limited, but in view of productivity, freeze drying, flash jet drying, fluidized drying and vibration-type fluidized drying are preferred.

The constituent components of the toner (raw materials used in the production process of the toner) are described below.

As for the colorant, the following colorants can be used. Examples of the black pigment include carbon black, copper oxide, manganese dioxide, aniline black, activated carbon, non-magnetic ferrite and magnetite.

Examples of the yellow pigment include lead yellow, zinc yellow, yellow iron oxide, cadmium yellow, chrome yellow, Hansa Yellow, Hansa Yellow 10G, Benzidine Yellow G, Benzidine Yellow GR, Suren Yellow, Quinoline Yellow and Permanent Yellow NCG.

Examples of the orange pigment include red chrome yellow, molybdenum orange, Permanent Orange GTR, Pyrazolone Orange, Vulcan Orange, Benzidine Orange G, Indanethrene Brilliant Orange RK and Indanethrene Brilliant Orange GK.

Examples of the red pigment include red iron oxide, cadmium red, red lead, mercury sulfide, Watchung Red, Permanent Red 4R, Lithol Red, Brilliant Carmine 3B, Brilliant Carmine 6B, DuPont Oil Red, Pyrazolone Red, Rhodamine B Lake, Lake Red C, Rose Bengal, Eoxine Red and Alizarin Lake.

Examples of the blue pigment include Prussian Blue, Cobalt Blue, Alkali Blue Lake, Victoria Blue Lake, Fast Sky Blue, Indanethrene Blue BC, Aniline Blue, Ultramarine Blue, Calco Oil Blue, Methylene Blue Chloride, Phthalocyanine Blue, Phthalocyanine Green and Malachite Green Oxalate.

Examples of the violet pigment include manganese violet, Fast Violet B and Methyl Violet Lake.

Examples of the green pigment include chromium oxide, chrome green, Pigment Green, Malachite Green Lake and Final Yellow Green G.

Examples of the white pigment include zinc white, titanium oxide, antimony white and zinc sulfide.

Examples of the extender pigment include barite powder, barium carbonate, clay, silica, white carbon, talc and alumina white.

The dye includes various dyes such as basic, acid, disperse and direct dyes, and examples thereof include nigrosine, Methylene Blue, Rose Bengal, Quinoline Yellow and Ultramarine Blue.

These colorants are used individually or as a mixture. From such a colorant, a liquid dispersion of colorant particles can be prepared by using, for example, a rotation shearing homogenizer, a media-type disperser such as ball mill, sand mill and attritor, or a high-pressure counter collision-type disperser. The colorant can also be dispersed in an aqueous system by a homogenizer with use of a surfactant having polarity.

The colorant is selected from the standpoint of color hue angle, color saturation, brightness, weather resistance, OHP transparency and dispersibility in the toner.

The colorant can be added in an amount of 4 to 15 wt % based on the total weight of the toner constituent solid contents. In the case of using a magnetic material as the black colorant, unlike other colorants, the colorant can be added in an amount of 12 to 240 wt %.

The amount of the colorant blended is an amount required for ensuring color forming property at the fixing. The center diameter (median diameter) of the colorant particle in the toner is preferably from 100 to 330 nm. Within this range, the OHP transparency and the color forming property can be ensured.

The center diameter (median diameter) of the colorant particle was measured, for example, by a laser diffraction-type particle size distribution measuring device (LA-700, Manufactured by Horiba Ltd.).

In the case of using the toner as a magnetic toner, a magnetic powder may be incorporated therein. Specifically, a substance which is magnetized in a magnetic field is used and, for example, a ferromagnetic powder such as iron, cobalt and nickel, or a compound such as ferrite and magnetite is used. In the case of obtaining the toner in an aqueous phase, care must be taken of the aqueous phase migration property of the magnetic material, and the surface of the magnetic material is preferably modified in advance, for example, subjected to a hydrophobing treatment.

Also, a magnetic material containing a metal (e.g., ferrite, magnetite, reduced iron, cobalt, nickel, manganese) or an alloy or compound containing such a metal can be used as an internal additive, and various charge controlling agents commonly employed, such as quaternary ammonium salt compound, nigrosine-based compound, dye comprising a complex of aluminum, iron or chromium, and triphenylmethane pigment, can be used as a charge controlling agent, but a material hardly dissolvable in water is preferred from the standpoint of controlling the ionic strength affecting the stability at the aggregation or coalescence and reducing the pollution due to wastewater.

Specific examples of the releasing agent include various ester waxes; low molecular weight polyolefins such as polyethylene, polypropylene and polybutene; silicones showing a softening point under heating; aliphatic amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; mineral or petroleum waxes such as montan wax, ozokerite, ceresin, paraffin wax, microcrystalline wax and Fischer-Tropsch wax; and a modified product thereof.

It is preferred that such a wax is scarcely dissolved in a solvent such as toluene near the room temperature and if dissolved, the amount dissolved is very small.

Such a wax is dispersed in an aqueous medium together with an ionic surfactant and a polymer electrolyte such as polymer acid or polymer base and under heating to a temperature higher than the melting point, dispersed into particles by a homogenizer or pressure jet-type disperser (GAULIN HOMOGENIZER, manufactured by Gaulin Corp.) capable of applying strong shear, whereby a liquid dispersion of particles of 1 μm or less can be produced.

From the standpoint of ensuring releasability of a fixed image in an oil-less fixing system, the releasing agent is preferably added in an amount of 5 to 25 wt % based on the total weight of the toner constituent solid contents.

The particle diameter of the releasing agent particle liquid dispersion was measured, for example, by a laser diffraction-type particle size distribution measuring device (LA-920, Manufactured by Horiba Ltd.). At the time of using the releasing agent, from the standpoint of ensuring the electrostatic property and durability, the resin particle liquid dispersion is preferably added after aggregating the resin particles, colorant particles and releasing agent particles, so that the resin particle can be attached on the surface of the aggregate particle.

The toner obtained by the production process of an electrostatic image developing toner of the present invention preferably has an accumulated volume average particle diameter $D_{50}$ of 3.0 to 9.0 μm, more preferably from 3.0 to 5.0 μm. Within this range, the adhesive force is not increased and good developability and high image resolution can be advantageously attained.

The volume average particle size distribution index GSDv of the toner obtained is preferably 1.30 or less. When the GSDv is 1.30 or less, good resolution can be obtained and scattering of toner or image defect such as fogging is advantageously less caused.

The accumulated volume average particle diameter $D_{50}$ and the average particle size distribution index are determined as follows. Respective cumulative distributions of volume and number are drawn from the small diameter side with respect to the divided particle size range (channel) based on the particle size distribution measured by a measuring meter such as COULTER COUNTER TAII (manufactured by Nikkaki Co., Ltd.) or MULTISIZER II (manufactured by Nikkaki Co., Ltd.). The particle size at 16% accumulation is defined as $D_{16V}$ for volume and $D_{16P}$ for number, the particle size at 50% accumulation is defined as $D_{50V}$ for volume and $D_{50P}$ for number, and the particle size at 84% accumulation is defined as $D_{84V}$ for volume and $D_{84P}$ for number. Using these, the volume average particle size distribution index (GSDv) is calculated as $(D_{84V}/D_{16V})^{1/2}$, and the number average particle size distribution index (GSDp) is calculated as $(D_{84P}/D_{16P})_{1/2}$.

In view of image forming property, the shape factor SF1 of the toner obtained is preferably from 100 to 140, more preferably from 110 to 135. The shape factor SF1 is determined as follows. An optical microscopic image of the toner scattered on a slide glass is input into a Luzex image analyzer through a video camera, the maximum length (ML) and the projected area (A) are measured for 50 or more toner particles, the SF1 is calculated according to the following formula, and its average value is obtained.

$$SF1 = \frac{(ML)^2}{A} \times \frac{\pi}{4} \times 100 \quad \text{Math. 1}$$

wherein ML represents a maximum length of toner particle and A represents a projected area of particle.

The toner obtained is dried in the same manner as a normal toner and before use, for the purpose of imparting flowability and enhancing the cleaning property, an inorganic particle such as silica, alumina, titania and calcium carbonate, or a resin particle such as vinyl-based resin, polyester and silicone, may be added to the toner particle surface while applying shear in a dry state.

In the case attaching the inorganic particle to the toner surface in an aqueous medium, all materials usually employed as the external additive to the toner surface, such as silica, alumina, titania, calcium carbonate, magnesium carbonate and tricalcium phosphate, may be used after dispersing these with an ionic surfactant, a polymer acid or a polymer base.

The toner obtained by the production process of an electrostatic image developing toner of the present invention is used as an electrostatic image developer. This developer is not particularly limited as long as it contains the electrostatic image developing toner, and may take an appropriate component composition according to the purpose. When the electrostatic image developing toner is used alone, the developer is prepared as a one-component system electrostatic image developer, whereas when the toner is used in combination with a carrier, the developer is prepared as a two-component system electrostatic image developer.

The carrier is not particularly limited, but examples of the carrier usually employed include a magnetic particle such as iron powder, ferrite, iron oxide powder and nickel; a resin-coated carrier obtained by coating the surface of a magnetic particle as a core material with a resin such as styrene-based resin, vinyl-based resin, ethyl-based resin, rosin-based resin, polyester-based resin and methyl-based resin or with a wax such as stearic acid to form a resin coat layer; and a magnetic material dispersion-type carrier obtained by dispersing magnetic particles in a binder resin. Among these, a resin-coated carrier is preferred because the toner chargeability or the resistance of the entire carrier can be controlled by the constitution of the resin coat layer.

The mixing ratio between the toner of the present invention and the carrier in the two-component system electrostatic image developer is usually from 2 to 10 parts by weight of toner per 100 parts by weight of carrier. The preparation method of the developer is not particularly limited, but examples thereof include a method of mixing the toner and the carrier by a V blender or the like.

The electrostatic image developer (electrostatic image developing toner) may also be used for the image forming method in a normal electrostatic image developing system (electrophotographic system).

The image forming method of the present invention is an image forming method comprising a latent image-forming step of forming an electrostatic latent image on the surface of a latent image holding member, a development step of developing the electrostatic latent image formed on the surface of the latent image holding member with a developer containing a toner to form a toner image, a transfer step of transferring the toner image formed on the surface of the latent image holding member to the surface of a transferring member, and a fixing step of heat-fixing the toner image transferred to the surface of the transferring member, wherein the electrostatic image developing toner of the present invention is used as the toner, or the electrostatic image developer of the present invention is used as the developer.

The above-described steps all may be performed by the steps known in the image forming method, for example, the steps described in JP-A-56-40868 and JP-A-49-91231. Also, the image forming method of the present invention may comprise a step other than those steps, and preferred examples of such a step include a cleaning step of removing the electrostatic image developer remaining on the electrostatic latent image holding member. In a preferred embodiment, the image forming method of the present invention further comprises a recycling step. This recycling step is a step of transferring the electrostatic image developing toner recovered in the cleaning step to the developer layer. The image forming method in this embodiment comprising a recycling step can be performed by using an image forming apparatus such as toner recycling system-type copying machine or facsimile machine. The image forming method of the present invention may also be applied to a recycling system in which the cleaning step is omitted and the toner is recovered simultaneously with the development.

As for the latent image holding member, for example, an electrophotographic photoreceptor or a dielectric recording material may be used.

In the case of the electrophotographic photoreceptor, the surface of the electrophotographic photoreceptor is uniformly charged by a corotron charging device or a contact charging device and then exposed to form an electrostatic latent image (latent image-forming step). Thereafter, the photoreceptor is caused to come in contact with or close to a developer roll having formed on the surface thereof a developer layer to allow for attachment of the toner particles to the electrostatic latent image, thereby forming a toner image on the electrophotographic photoreceptor (development step). The toner image formed is transferred to the surface of a transferring member such as paper by using a corotron charging device (transfer step). Furthermore, the toner image transferred to the transferring member surface is heat-fixed by a fixing machine to form a final toner image.

At the heat-fixing by the fixing machine, a releasing agent is generally supplied to the fixing member of the fixing machine so as to prevent offset or the like.

EXAMPLE

The present invention is described in greater detail below by referring to Examples, but these Examples in no way limit the present invention.

The toner of Examples is produced as follows. The following resin particle liquid dispersion, colorant particle liquid dispersion and releasing agent particle liquid dispersion are separately prepared and mixed at a predetermined ratio. A coagulant is added thereto with stirring to form aggregate particles, and an inorganic hydroxide is added to adjust the pH in the system to a region from weakly acidic to neutral. Thereafter, the system is heated at a temperature higher than the glass transition point of the resin particle to effect fusing and coalescence and after the completion of reaction, a thorough washing step, a solid-liquid separation step and a drying step are performed to obtain a desired toner. Respective preparation methods are described below.

Example 1

Example 1-1

Preparation of Resin Particle Liquid Dispersion (1)

| | |
|---|---|
| Dodecylbenzenesulfonic acid | 3.6 parts by weight |
| 1,9-Nonanediol | 80.0 parts by weight |
| 1,10-Decanedicarboxylic acid | 115.0 parts by weight |

These materials were mixed in a 500 ml-volume flask, and the mixture was melted under heating at 120° C. by a mantle heater and then kept at 90° C. for 8 hours while stirring with Three-One Motor and expelling the gas, as a result, the contents became a viscous melt.

An aqueous solution for neutralization prepared by dissolving 2.0 parts by weight of an aqueous 1 N NaOH solution in 790 parts by weight of ion exchanged water heated at 90° C. was charged into the flask and after emulsification in a homogenizer (ULTRA-TURRAX, manufactured by IKA Works, Inc.) for 5 minutes, the flask was cooled in water at room temperature.

In this way, Crystalline Polyester Resin Particle Liquid Dispersion (1) was obtained, in which the center diameter of the resin particle was 220 nm, the melting point was 71° C., the weight average molecular weight was 14,000 and the solid content was 20%.

In the particles of Resin Particle Liquid Dispersion (1), the overall ratio of particles having a median diameter of 0.03 μm or less or 5.0 μm or less (hereinafter referred to as a "large/small particle overall ratio") was 2.0%. The pH of the liquid dispersion was 7.5.

The stability of Resin Particle Liquid Dispersion (1) used was examined by a method of weighing 100 g of the resin particle liquid dispersion in a 300 ml-volume stainless steel beaker, homogenizing it with shear by IKA ULTRA-TURRAX T50 in the beaker for 1 minute, filtering the resin particle liquid dispersion through a 77-micron nylon mesh, and observing the presence or absence of generation of aggregation, as a result, generation of aggregates was not observed at all and the liquid dispersion was in a stable state (A).

Example 1-2

Preparation of Resin Particle Liquid Dispersion (2)

| | |
|---|---|
| Dodecylbenzenesulfonic acid | 3.6 parts by weight |
| 1,6-Hexanediol | 59 parts by weight |
| Sebacic acid | 101 parts by weight |

These materials were mixed in a 500 ml-volume flask, and the mixture was melted under heating at 130° C. by a mantle heater and then kept at 80° C. for 8 hours while stirring with Three-One Motor and expelling the gas, as a result, the contents became a viscous melt.

An aqueous solution for neutralization prepared by dissolving 2.0 parts by weight of an aqueous 1N NaOH solution in 650 parts by weight of ion exchanged water heated at 80° C. was charged into the flask and after emulsification in a homogenizer (Ultra-Turrax, manufactured by IKA Works, Inc.) for 5 minutes, the flask was cooled in water at room temperature.

In this way, Crystalline Polyester Resin Particle Liquid Dispersion (2) was obtained, in which the center diameter of the resin particle was 240 nm, the melting point was 69° C., the weight average molecular weight was 11,000 and the solid content was 20%.

The particles of Resin Particle Liquid Dispersion (2) had a large/small particle overall ratio of 4.7%, and the pH of the liquid dispersion was 6.8.

The stability of Resin Particle Liquid Dispersion (2) used was examined by the above-described method of homogenization with shear, as a result, generation of aggregation was not observed at all and the liquid dispersion was stable (A).

Example 1-3

Preparation of Resin Particle Liquid Dispersion (3)

| | |
|---|---|
| Dodecylsulfuric acid | 3.0 parts by weight |
| 1,9-Nonanediol | 80 parts by weight |
| Azelaic acid | 94 parts by weight |

These materials were mixed in a 500 ml-volume flask, and the mixture was melted under heating at 110° C. by a mantle heater and then kept at 70° C. for 8 hours while stirring with Three-One Motor and reducing the pressure, as a result, the contents became a viscous melt.

An aqueous solution for neutralization prepared by dissolving 2.0 parts by weight of an aqueous 1N NaOH solution in 650 parts by weight of ion exchanged water heated at 70° C. was charged into the flask and after emulsification in a homogenizer (ULTRA-TURRAX manufactured by IKA Works, Inc.) for 5 minutes, the flask was cooled in water at room temperature.

In this way, Crystalline Polyester Resin Particle Liquid Dispersion (3) was obtained, in which the median diameter of the resin particle was 190 nm, the melting point was 54° C., the weight average molecular weight was 9,000 and the solid content was 20%.

The particles of Resin Particle Liquid Dispersion (3) had a large/small particle overall ratio of 0.8%, and the pH of the liquid dispersion was 7.1.

The stability of Resin Particle Liquid Dispersion (3) used was examined by the above-described method of homogenization with shear, as a result, generation of aggregation was not observed at all and the liquid dispersion was stable (A).

Example 1-4

Preparation of Resin Particle Liquid Dispersion (4)

| | |
|---|---|
| Para-toluenesulfonic acid | 2.5 parts by weight |
| Scandium dodecylbenzenesulfonate (rare earth-containing catalyst) | 3.6 parts by weight |
| Terephthalic acid | 46 parts by weight |
| Polyoxyethylene(2.4)-2,2-bis(4-hydroxyphenyl)propane | 34 parts by weight |
| Ethylene glycol | 20 parts by weight |

These materials were mixed in a 500 ml-volume flask, and the mixture was melted under heating at 140° C. by a mantle heater and then kept at 140° C. for 10 hours while stirring with Three-One Motor and expelling the gas, as a result, the contents became a viscous melt.

An aqueous solution for neutralization prepared by dissolving 3.0 parts by weight of an aqueous 1 N NaOH solution in 425 parts by weight of ion exchanged water heated at 90° C. was charged into the flask and after emulsification in a homogenizer (ULTRA-TURRAX, manufactured by IKA Works, Inc.) for 10 minutes, the flask was cooled in water at room temperature.

In this way, Non-Crystalline Polyester Resin Particle Liquid Dispersion (4) was obtained, in which the median diameter of the resin particle was 280 nm, the glass transition point was 55° C., the weight average molecular weight was 13,500 and the solid content was 20%.

The particles of Resin Particle Liquid Dispersion (4) had a large/small particle overall ratio of 3.5%, and the pH of the liquid dispersion was 7.8.

The stability of Resin Particle Liquid Dispersion (4) used was examined by the above-described method of homogenization with shear, as a result, generation of aggregation was slightly observed but in a level of no problem (B).

Example 1-5

Preparation of Resin Particle Liquid Dispersion (5)

| | |
|---|---|
| Dodecylbenzenesulfonic acid | 2.4 parts by weight |
| Lipase (originated in *Pseudomonas* group; enzyme catalyst) | 10 parts by weight |
| 1,9-Nonanediol | 80 parts by weight |
| 1,10-Decanedicarboxylic acid | 115 parts by weight |

These materials were mixed in a 500 ml-volume flask according to the formulation above, and the mixture was melted under heating at 120° C. by a mantle heater and then kept at 80° C. for 10 hours while stirring with Three-One Motor and expelling the gas, as a result, the contents became a viscous melt.

An aqueous solution for neutralization prepared by dissolving 2.0 parts by weight of an aqueous 1N NaOH solution in 820 parts by weight of ion exchanged water heated at 80° C. was charged into the flask and after emulsification in a homogenizer (ULTRA-TURRAX, manufactured by IKA Works, Inc.) for 5 minutes and further in an ultrasonic bath for 10 minutes, the flask was cooled in water at room temperature.

In this way, Non-Crystalline Polyester Resin Particle Liquid Dispersion (5) was obtained, in which the median diameter of the resin particle was 180 nm, the melting point was 70° C., the weight average molecular weight was 15,000 and the solid content was 20%.

The particles of Resin Particle Liquid Dispersion (5) had a large/small particle overall ratio of 4.2%, and the pH of the liquid dispersion was 6.3.

The stability of Resin Particle Liquid Dispersion (5) used was examined by the above-described method of homogenization with shear, as a result, generation of aggregation was slightly observed but in a level of no problem (B).

Comparative Example 1-1

Preparation of Resin Particle Liquid Dispersion (6)

| | |
|---|---|
| Dodecylbenzenesulfonic acid | 1.8 parts by weight |
| 1,9-Nonanediol | 80 parts by weight |
| 1,10-Decanedicarboxylic acid | 115 parts by weight |

These raw materials were mixed in a 500 ml-volume flask according to the formulation above, and the mixture was melted under heating at 120° C. by a mantle heater and then kept at 90° C. for 8 hours while stirring with Three-One Motor and expelling the gas, as a result, the contents became a viscous melt.

Thereafter, 790 g of ion exchanged water heated at 90° C., in which a base for neutralization was not added, was charged into the flask and after emulsification in a homogenizer (ULTRA-TURRAX, manufactured by IKA Works, Inc.) for 5 minutes, the flask was cooled in water at room temperature.

In this way, Crystalline Polyester Resin Particle Liquid Dispersion (6) was obtained, in which the median diameter of the resin particle was 2,050 nm, the melting point was 70° C., the weight average molecular weight was 9,500 and the solid content was 20%.

The particles of Resin Particle Liquid Dispersion (6) had a large/small particle overall ratio of 10.8%, and the pH of the liquid dispersion was 2.5.

The stability of Resin Particle Liquid Dispersion (6) used was examined by the above-described method of homogenization with shear, as a result, generation of a large amount of aggregates was observed (D).

Comparative Example 1-2

Preparation of Resin Particle Liquid Dispersion (7)

| | |
|---|---|
| Dodecylbenzenesulfonic acid | 3.6 parts by weight |
| 1,4-Butanediol | 45 parts by weight |
| Azelaic acid | 94 parts by weight |

These materials were mixed in a 500 ml-volume flask according to the formulation above, and the mixture was melted under heating at 110° C. by a mantle heater and then kept at 80° C. for 8 hours while stirring with Three-One Motor and expelling the gas, as a result, the contents became a viscous melt.

An aqueous solution for neutralization prepared by dissolving 2.0 parts by weight of an aqueous 1N NaOH solution in 570 parts by weight of ion exchanged water heated at 80° C. was charged into the flask and after emulsification in a homogenizer (ULTRA-TURRAX, manufactured by IKA Works, Inc.) for 10 minutes and further in an ultrasonic bath for 10 minutes, the flask was cooled in water at room temperature.

In this way, Crystalline Polyester Resin Particle Liquid Dispersion (7) was obtained, in which the median diameter of the resin particle was 40 nm, the melting point was 47° C., the weight average molecular weight was 21,000 and the solid content was 20%.

The particles of Resin Particle Liquid Dispersion (7) had a large/small particle overall ratio of 10.8%, and the pH of the liquid dispersion was 7.2.

The stability of Resin Particle Liquid Dispersion (7) used was examined by the above-described method of homogenization with shear, as a result, generation of aggregation was observed (D).

These results of Examples 1-1 to 1-5 and Comparative Examples 1-1 and 1-2 are shown in Table 1-1.

In the Table, the stability of the resin particle liquid dispersion was evaluated according to the following criteria:

A: absolutely no generation of aggregation;

B: slightly generated but no problem;

C: somewhat generated;

D: generation of a large amount of aggregates.

TABLE 1-1

| | Example | | | | | Comparative Example | |
|---|---|---|---|---|---|---|---|
| Resin Particle Liquid Dispersion | 1-1 | 1-2 | 1-3 | 1-4 | 1-5 | 1-1 | 1-2 |
| Resin particle; median diameter, μm | (1) 0.22 | (2) 0.24 | (3) 0.19 | (4) 0.28 | (5) 0.18 | (6) 2.05 | (7) 0.04 |
| Crystalline resin; melting point, ° C. | (1) 71 | (2) 69 | (3) 54 | | (5) 70 | (6) 70 | (7) 47 |
| Non-crystalline resin; glass transition point, ° C. | | | | (4) 55 | | | |
| Temperature at melt-mixing, ° C. | 120 | 130 | 110 | 140 | 120 | 120 | 110 |
| Temperature at polycondensation, ° C. | 90 | 80 | 70 | 140 | 80 | 90 | 80 |
| Temperature at emulsification dispersion, ° C. | 90 | 80 | 70 | 90 | 80 | 90 | 80 |
| Stability of resin liquid dispersion | A | A | A | B | B | D | D |
| pH of Resin liquid dispersion | 7.5 | 6.8 | 7.1 | 7.8 | 6.3 | 2.5 | 7.2 |

It is seen from the results shown in Table 1-1 that as in Examples of the present invention, when polycondensed resin particles are polycondensed at a low temperature and emulsification-dispersed simultaneously with neutralization and the median diameter thereof is within a predetermined range, the stability of the resin particle liquid dispersion is enhanced.

On the other hand, as in Comparative Examples, when polycondensed resin particles are prepared by emulsification-dispersing a polycondensed resin but the median diameter thereof is not within a predetermined range, or when the median diameter is within a predetermined range but the polycondensed resin particles are prepared by separately obtaining a polycondensed resin and dispersing it in an aqueous medium, the stability of the resin particle liquid dispersion is poor.

Preparation of Resin Particle Liquid Dispersion (8): Non-Crystal Vinyl-Based Resin

| | |
|---|---|
| Styrene | 460 parts by weight |
| n-Butyl acrylate | 140 parts by weight |
| Acrylic acid | 12 parts by weight |
| Dodecanethiol | 9 parts by weight |

Respective components were mixed and dissolved according to the formulation above to prepare a solution. After 12 parts by weight of an anionic surfactant (DOWFAX, produced by Rhodia, Inc.) was dissolved in 250 parts by weight of ion exchanged water, the solution prepared above was added thereto and dispersed and emulsified in a flask (Monomer Emulsion A). Furthermore, 1 part by weight of the same anionic surfactant (DOWFAX produced by Rhoda, Inc.) was dissolved in 555 parts by weight of ion exchanged water and the resulting solution was charged into a polymerization flask. The polymerization flask was tightly plugged and after a reflux tube was equipped, the polymerization flask was heated to 75° C. on a water bath while injecting nitrogen and slowly stirring, and then kept as-is.

Subsequently, 9 parts by weight of ammonium persulfate was dissolved in 43 parts by weight of ion exchanged water, the resulting solution was added dropwise into the polymerization flask through a metering pump over 20 minutes, and then Monomer Emulsion A was added dropwise through a metering pump over 200 minutes.

Thereafter, the polymerization flask was kept at 75° C. for 3 hours while continuing slowly stirring to complete the polymerization.

In this way, Anionic Resin Particle Liquid Dispersion (8) was obtained, in which the median diameter of the resin particle was 210 nm, the glass transition point was 53.5° C., the weight average molecular weight was 31,000 and the solid content was 42%.

The particles of Resin Particle Liquid Dispersion (8) had a large/small particle overall ratio of 0.2%.

| (Preparation of Colorant Particle Liquid Dispersion (1)) | |
|---|---|
| Yellow pigment (Y74, produced by Dainichiseika Colour & Chemicals Mfg. Co., Ltd.) | 50 parts by weight |
| Anionic surfactant (NEOGEN R, produced by Dai-ichi Kogyo Seiyaku Co., Ltd.) | 5 parts by weight |
| Ion exchanged water | 200 parts by weight |

These components were mixed and dissolved according to the formulation above, and the resulting solution was dispersed by a homogenizer (Ultra-Turrax, manufactured by IKA Works, Inc.) for 5 minutes and further by an ultrasonic bath for 10 minutes to obtain Yellow Colorant Particle Liquid Dispersion (1) having a center diameter (median diameter) of 240 nm and a solid content of 21.5%.

Preparation of Colorant Particle Liquid Dispersion (2)

Cyan Colorant Particle Liquid Dispersion (2) having a center diameter (median diameter) of 190 nm and a solid content of 21.5% was prepared in the same manner as Colorant Particle Liquid Dispersion (1) except that in the preparation of Colorant Particle Liquid Dispersion (1), a cyan pigment (Copper Phthalocyanine B15:3, produced by Dainichiseika Colour & Chemicals Mfg. Co., Ltd.) was used in place of the yellow pigment.

Preparation of Colorant Particle Liquid Dispersion (3)

Magenta Colorant Particle Liquid Dispersion (3) having a center diameter (median diameter) of 165 nm and a solid content of 21.5% was prepared in the same manner as Colorant Particle Liquid Dispersion (1) except that in the preparation of Colorant Particle Liquid Dispersion (1), a magenta pigment (PR122, produced by Dai-Nippon Ink & Chemicals, Inc.) was used in place of the yellow pigment.

Preparation of Colorant Particle Liquid Dispersion (4)

Black Colorant Particle Liquid Dispersion (4) having a center diameter (median diameter) of 170 nm and a solid content of 21.5% was prepared in the same manner as Colorant Particle Liquid Dispersion (1) except that in the preparation of Colorant Particle Liquid Dispersion (1), a black pigment (carbon black, produced by Cabot, Inc.) was used in place of the yellow pigment.

| (Preparation of Releasing Agent Particle Liquid Dispersion) | |
|---|---|
| Paraffin wax (HNP9, produced by Nippon Seiro Co., Ltd.; melting point: 70° C.) | 50 parts by weight |
| Anionic surfactant (DOWFAX, produced by Rhodia, Inc.) | 5 parts by weight |
| Ion exchanged water | 200 parts by weight |

The components according to the formulation above were heated to 95° C. and after thorough dispersion by a homogenizer (ULTRA-TURRAX T50, manufactured by IKA Works, Inc.), subjected to a dispersion treatment in a pressure jet-type homogenizer (GAULIN HOMOGENIZER, manufactured by Gaulin Corp.) to obtain a releasing agent particle liquid dispersion having a center diameter (median diameter) of 180 nm and a solid content of 21.5%.

Toner Example 1-6

| (Preparation of Toner Particle) | |
|---|---|
| Resin Particle Liquid Dispersion (1) | 210 parts by weight (resin: parts by weight) |
| Resin Particle Liquid Dispersion (8) | 50 parts by weight (resin: 21 parts by weight) |
| Colorant Particle Liquid Dispersion (1) | 40 parts by weight (colorant: 8.6 parts by weight) |
| Releasing Agent Particle Liquid Dispersion | 40 parts by weight (releasing agent: 8.6 parts by weight) |
| Polyaluminum chloride | 0.15 parts by weight |
| Ion exchanged water | 300 parts by weight |

The components (excluding Resin Particle Liquid Dispersion (8)) according to the formulation above were thoroughly mixed and dispersed in a round stainless steel-made flask by a homogenizer (ULTRA-TURRAX T50, manufactured by IKA Works, Inc.) and after the flask was heated to 42° C. over a heating oil bath while stirring and then kept at 42° C. for 60 minutes, 50 parts by weight (resin: 21 parts by weight) of Resin Particle Liquid Dispersion (8) was additionally added and gently stirred.

Thereafter, the pH in the system was adjusted to 6.0 with 0.5 mol/liter of an aqueous sodium hydroxide solution, and then the system was heated to 95° C. while continuing stirring. In the time period of elevating the temperature to 95° C., the pH in the system usually decreases to 5.0 or less but here, the pH was kept not to decrease to 5.5 or less by additionally adding dropwise the aqueous sodium hydroxide solution.

After the completion of reaction, the reaction solution was cooled, filtrated, thoroughly washed with ion exchanged water and then subjected to solid-liquid separation by Nutsche suction filtration. The solid portion was again dispersed in 3 liter of ion exchanged water at 40° C., and then washed by stirring for 15 minutes at 300 rpm. This washing operation was repeated five times. Subsequently, the resulting solution was subjected to solid-liquid separation by Nutsche suction filtration, and the solid portion was vacuum-dried for 12 hours to obtain toner particles.

The particle diameter of the obtained toner particle was measured by a COULTER COUNTER, as a result, the accumulated volume average particle diameter $D_{50}$ was 4.8 μm, and the volume average particle size distribution index GSDv was 1.22. Also, the shape factor SF1 of the toner particle was determined by the observation of shape with a LUZEX image analyzer and found to be 131, and the particle shape was a potato-like shape.

Subsequently, 1.5 parts by weight of hydrophobic silica (TS720, produced by Cabot, Inc.) was added to 50 parts by weight of the toner particles obtained above, and mixed in a sample mill to obtain an external addition toner.

A ferrite carrier having an average particle diameter of 50 μm, which was coated with polymethyl methacrylate (produced by Soken Chemical & Engineering Co., Ltd.) to a coverage of 1%, was used as the carrier and after weighing the external addition toner to give a toner concentration of 5%, the carrier and the toner were stirred and mixed in a ball mill for 5 minutes to prepare a developer.

Evaluation of Toner

Using the developer prepared above, the fixability of the toner was examined in a modified machine of DOCUCENTER COLOR 500 manufactured by Fuji Xerox Co., Ltd., by using J coat paper produced by Fuji Xerox Co., Ltd. as the transfer sheet and adjusting the process speed to 180 mm/sec. As a result, it was confirmed that the oil-less fixability by a PFA tube fixing roll was good, the lowest fixing temperature was 115° C. or more, the image was exhibiting satisfactory fixability, and the transfer sheet was separated without any resistance.

Incidentally, the lowest fixing temperature is defined as a fixing temperature where when the temperature is gradually elevated from a low temperature (usually around 70° C.) and when the image fixed is rubbed with a white gauze, staining of image or attachment of toner to the gauze does not occur.

The image quality was examined by using the above-described modified machine under the same conditions, as a result, the image obtained at a fixing temperature of 140° C. was a high-quality image (B) endowed with good surface gloss of 65%, satisfied in both developability and transferability, and free from image defects.

Furthermore, generation of hot offset was examined by gradually elevating the fixing temperature in the above-described modified machine under the same conditions, as a result, generation of hot offset was not observed even at a fixing temperature of 200° C.

Also, when a continuous printing test of 50,000 sheets was performed at 23° C.-55% RH in the above-described modified machine, the initial good image quality was maintained to the end (maintenance at continuous test: B).

Toner Example 1-7

Toner particles were obtained in the same manner as in Example 1-6 except that in Example 1-6, Resin Particle Liquid Dispersion (1) was changed to Resin Particle Liquid Dispersion (2), Colorant Particle Liquid Dispersion (1) was changed to Colorant Particle Liquid Dispersion (2), and the pH at the heating to 95° C. was kept at 5.0.

The accumulated volume average particle diameter $D_{50}$ of this toner particle was 4.50 μm, the volume average particle size distribution index GSDv was 1.20, and the particle shape was slightly spherical with a shape factor SF1 of 125.

An external addition toner was obtained by using this toner particle in the same manner as in Example 1-1 and a developer was further prepared therefrom. The fixability of the toner was examined in the same manner as in Example 6, as a result, it was confirmed that the oil-less fixability by a PFA tube fixing roll was good, the lowest fixing temperature was 110°0 C. or more, the image was exhibiting satisfactory fixability, and the transfer sheet was separated without any resistance. The image obtained at a fixing temperature of 150° C. was a high-quality image (B) endowed with good surface gloss of 70%, satisfied in both developability and transferability, and free from image defects. Furthermore, generation of hot offset was not observed even at a fixing temperature of 200° C.

Also, when a continuous printing test of 50,000 sheets was performed at 23° C.-55% RH in the above-described modified machine, the initial good image quality was maintained to the end (maintenance at continuous test: B).

Toner Example 1-8

Toner particles were obtained in the same manner as in Example 1-6 except that in Example 1-6, Resin Particle Liquid Dispersion (1) was changed to Resin Particle Liquid Dispersion (3), Resin Particle Liquid Dispersion (8) was changed to Resin Particle Liquid Dispersion (4), Colorant Particle Liquid Dispersion (2) was changed to Colorant Particle Liquid Dispersion (3), and the amount of polyaluminum chloride was changed to 0.12 parts by weight.

The accumulated volume average particle diameter $D_{50}$ of this toner particle was 4.20 μm, the volume average particle size distribution index GSDv was 1.24, and the particle shape was spherical with a shape factor SF1 of 120.

An external addition toner was obtained by using this toner particle in the same manner as in Example 1-6 and a developer was further prepared therefrom. The fixability of the toner was examined in the same manner as in Example 1-1, as a result, it was confirmed that the oil-less fixability by a PFA tube fixing roll was good, the lowest fixing temperature was 105° C. or more, the image was exhibiting satisfactory fixability, and the transfer sheet was separated without any resistance. The image obtained at a fixing temperature of 150° C. was an extremely high-quality image (B) endowed with good surface gloss of 80%, satisfied in both developability and transferability, and free from image defects. Furthermore, generation of hot offset was not observed even at a fixing temperature of 200° C.

Also, when a continuous printing test of 50,000 sheets was performed at 23° C.-55% RH in the above-described modified machine, the initial good image quality was maintained to the end (maintenance at continuous test: B).

Toner Example 1-9

Toner particles were obtained in the same manner as in Example 1-6 except that in Example 1-6, Resin Particle Liquid Dispersion (1) was changed to Resin Particle Liquid Dispersion (5) and Colorant Liquid Dispersion (1) was changed to Colorant Liquid Dispersion (4).

The accumulated volume average particle diameter $D_{50}$ of this toner particle was 3.80 μm, the volume average particle size distribution index GSDv was 1.25, and the particle shape was a potato-like shape with a shape factor SF1 of 133.

An external addition toner was obtained by using this toner particle in the same manner as in Example 1-6 and a developer was further prepared therefrom. The fixability of the toner was examined in the same manner as in Example 1-1, as a result, it was confirmed that the oil-less fixability by a PFA tube fixing roll was good, the lowest fixing temperature was 110° C. or more, the image was exhibiting satisfactory fixability, and the transfer sheet was separated without any resistance. The image obtained at a fixing temperature of 150° C. was a high-quality image (B) endowed with good surface gloss of 50%, satisfied in both developability and transferability, and free from image defects. Furthermore, generation of hot offset was not observed even at a fixing temperature of 200° C.

Also, when a continuous printing test of 50,000 sheets was performed at 23° C.-55% RH in the above-described modified machine, the initial good image quality was maintained to the end (maintenance at continuous test: B).

Toner Comparative Example 1-3

Toner particles were obtained in the same manner as in Example 1-7 except that in Example 1-7, Resin Particle Liquid Dispersion (2) was changed to Resin Particle Liquid Dispersion (6).

The accumulated volume average particle diameter $D_{50}$ of this toner particle was 5.90 μm, the volume average particle size distribution index GSDv was 1.30, and the particle shape was a potato-like shape with a shape factor SF1 of 137.

An external addition toner was obtained by using this toner particle in the same manner as in Example 1-6 and a developer was further prepared therefrom. The fixability of the toner was examined in the same manner as in Example 1-1, as a result, it was confirmed that the oil-less fixability by a PFA tube fixing roll was good, the lowest fixing temperature was 130° C. or more, and the image was exhibiting satisfactory fixability, but the separation state of transfer sheet was bad and the sheet after fixing was corrugating or wrapping. Furthermore, generation of hot offset was observed from a fixing temperature of 180° C. Also, generation of coarse powder was observed in the toner and an image defect such as white spot was observed.

A continuous printing test was performed at 23° C.-55% RH in the above-described modified machine, but the white spot in the image was more worsened from the initial image quality and the evaluation was discontinued at the 5,000th sheet (maintenance at continuous test: D).

Toner Comparative Example 1-4

Toner particles were obtained in the same manner as in Example 1-7 except that in Example 1-7, Resin Particle Liquid Dispersion (2) was changed to Resin Particle Liquid Dispersion (7).

The accumulated volume average particle diameter $D_{50}$ of this toner particle was 5.40 μm, the volume average particle size distribution index GSDv was 1.26, and the particle shape was spherical with a shape factor SF1 of 122.

An external addition toner was obtained by using this toner particle in the same manner as in Example 1-6 and a developer was further prepared therefrom. The fixability of the toner was examined in the same manner as in Example 1-1, as a result, it was confirmed that the oil-less fixability by a PFA tube fixing roll was not good, the lowest fixing temperature was 90° C. or more, and although the image was exhibiting satisfactory fixability, the separation state of transfer sheet was bad and the sheet after fixing was corrugating or wrapping. Furthermore, generation of serious hot offset was observed from a fixing temperature of 140° C. Also, an image defect was observed (D) and the evaluation of image was not good. Since the image defect and wrapping of the sheet after fixing were severe, a continuous printing test could not be performed (maintenance at continuous test: E).

These results of Examples 1-6 to 1-9 and Comparative Examples 1-3 and 1-4 are shown together in Table 1-2.

The image quality was evaluated according to the following criteria:

A: very good;

B: good;

D: image defects were generated.

The evaluation of maintenance at continuous test was as described above in Examples and Comparative Examples.

TABLE 1-2

| | Toner Example | | | | Toner Comparative Example | |
|---|---|---|---|---|---|---|
| | 1-6 | 1-7 | 1-8 | 1-9 | 1-3 | 1-4 |
| Resin particle liquid dispersion, parts by weight | (1) 210<br>(8) 50 | (2) 210<br>(8) 50 | (3) 210<br>(4) 105 | (5) 210<br>(4) 105 | (6) 210<br>(8) 50 | (7) 210<br>(8) 50 |
| Colorant liquid dispersion, parts by weight | (1) 40 | (2) 40 | (3) 40 | (4) 40 | (2) 40 | (2) 40 |
| Releasing agent liquid dispersion, parts by weight | 40 | 40 | 40 | 40 | 40 | 40 |
| Resin particle; median diameter, μm | (1) 0.22 | (2) 0.24 | (3) 0.19 | (5) 0.18 | (6) 2.05 | (7) 0.04 |
| Non-crystal resin; median particle, μm | (8) 0.21 | (8) 0.21 | (4) 0.28 | (4) 0.28 | (8) 0.21 | (8) 0.21 |
| crystal resin; melting point, ° C. | (1) 71 | (2) 69 | (3) 54 | (5) 70 | (6) 70 | (7) 47 |
| Non-crystal resin; glass transition point, ° C. | (8) 53.5 | (8) 53.5 | (4) 55 | (4) 55 | (8) 53.5 | (8) 53.5 |
| Large/small particle overall ratio of resin particle liquid dispersion | (1) 2.0<br>(8) 0.2 | (2) 4.7<br>(8) 0.2 | (3) 0.8<br>(4) 3.5 | (5) 4.2<br>(4) 3.5 | (6) 11.5<br>(8) 0.2 | (7) 11.8<br>(8) 0.2 |
| Particle diameter of toner, μm | 4.8 | 4.5 | 4.2 | 3.8 | 5.9 | 5.4 |
| Shape factor of toner | 131 | 125 | 120 | 133 | 137 | 122 |
| Lowest fixing temperature, ° C. | 115 | 110 | 105 | 110 | 130 | 90 |
| Hot offset temperature, ° C. | 200 or more | 200 or more | 200 or more | 200 or more | 180 | 140 |
| Image quality | B | B | A | B | D | D |
| Maintenance at continuous test | B | B | B | B | D | E |

Example 2

| (Preparation of Co-Present Non-crystalline Polycondensed Resin 1) | |
|---|---|
| Polyoxypropylene(2.2)-2,2-bis(4-hydroxyphenyl)propane | 500 parts by weight |
| Polyoxyethylene(2.2)-2,2-bis(4-hydroxyphenyl)propane | 24 parts by weight |
| Fumaric acid | 78 parts by weight |
| Dimethyl terephthalate | 63 parts by weight |
| Adipic acid | 76 parts by weight |
| Dibutyltin oxide | 0.5 parts by weight |

These raw materials were charged into a glass-made 3 liter-volume four-neck flask and after fixing thereto a thermometer, a stainless steel-made stirring bar, a condenser and a nitrogen inlet tube, polymerization was performed at 220°

C. under reduced pressure for 15 hours in a nitrogen stream by using a mantle heater. The obtained polyester was designated as Co-Present Non-Crystalline Polycondensed Resin 1. The weight average molecular weight was 14,000 and the glass transition point was 56.0° C.

| (Preparation of Co-Present Non-crystalline Polycondensed Resin 2) | |
|---|---|
| Dodecylbenzenesulfonic acid | 9.0 parts by weight |
| 1,9-Nonanediol | 200 parts by weight |
| 1,10-Decanedicarboxylic acid | 287.5 parts by weight |

These raw materials were charged into a glass-made 3 liter-volume four-neck flask and after fixing thereto a thermometer, a stainless steel-made stirring bar, a condenser and a nitrogen inlet tube, polymerization was performed at 100° C. under reduced pressure for 8 hours in a nitrogen stream by using a mantle heater. The obtained polyester was designated as Co-Present Crystalline Polycondensed Resin 2. The weight average molecular weight was 18,000 and the melting point was 74.0° C.

Example 2-1

Preparation of Resin Particle Liquid Dispersion (1)

| | |
|---|---|
| Dodecylbenzenesulfonic acid | 3.6 parts by weight |
| 1,9-Nonanediol | 80.0 parts by weight |
| 1,10-Decanedicarboxylic acid | 115.0 parts by weight |
| Co-Present Non-Crystalline Polycondensed Resin 1 | 195 parts by weight |

These raw materials were charged and mixed in a 3 liter-volume four-neck flask, and the mixture was melted under heating at 120° C. by a mantle heater and then kept at 90° C. for 8 hours while stirring with Three-One Motor and expelling the gas, as a result, the contents became a more viscous melt.

An aqueous solution for neutralization prepared by dissolving 2.0 parts by weight of an aqueous 1N NaOH solution in 1,580 parts by weight of ion exchanged water heated at 90° C. was charged into the flask and after emulsification in a homogenizer (ULTRA-TURRAX, manufactured by IKA Works, Inc.) for 15 minutes, the flask was cooled in water at room temperature In this way, Crystal-Non-Crystal Mixed Polyester Resin Particle Liquid Dispersion (1) was obtained, in which the center diameter of the particle was 340 nm, the melting point of the crystal resin was 68° C., the glass transition point of the non-crystal resin was 54° C. and the solid content was 20%. The weight average molecular weight as a total was 14,000.

In the particles of Resin Particle Liquid Dispersion (1), the overall ratio of particles having a median diameter of 0.03 μm or less or 5.0 μm or less (hereinafter referred to as a "large/small particle overall ratio") was 4.3%.

The stability of Resin Particle Liquid Dispersion (1) was examined by a method of weighing 100 g of the resin particle liquid dispersion in a 300 ml-volume stainless steel beaker, homogenizing it with shear by IKA ULTRA-TURRAX T50 in the beaker for 1 minute, filtering the resin particle liquid dispersion through a 77-micron nylon mesh, and observing the presence or absence of generation of aggregation, as a result, generation of aggregates was not observed at all and the liquid dispersion was in a stable state (A).

Example 2-2

Preparation of Resin Particle Liquid Dispersion (2)

| | |
|---|---|
| Dodecylbenzenesulfonic acid | 3.6 parts by weight |
| 1,6-Hexanediol | 59 parts by weight |
| Sebacic acid | 101 parts by weight |
| Co-Present Non-Crystalline Polycondensed Resin 1 | 80 parts by weight |

These raw materials were charged and mixed in a 3 liter-volume four-neck flask, and the mixture was melted under heating at 130° C. by a mantle heater and then kept at 90° C. for 8 hours while stirring with Three-One Motor and expelling the gas, as a result, the contents became a more viscous melt.

An aqueous solution for neutralization prepared by dissolving 2.0 parts by weight of an aqueous 1N NaOH solution in 960 parts by weight of ion exchanged water heated at 80° C. was charged into the flask and after emulsification in a homogenizer (ULTRA-TURRAX, manufactured by IKA Works, Inc.) for 15 minutes, the flask was cooled in water at room temperature.

In this way, Crystal-Non-Crystal Mixed Polyester Resin Particle Liquid Dispersion (2) was obtained, in which the center diameter of the particle was 440 nm, the melting point of the crystal resin was 67° C., the glass transition point of the non-crystal resin was 52° C., the total weight average molecular weight was 17,000 and the solid content was 20%.

The particles of Resin Particle Liquid Dispersion (2) had a large/small particle overall ratio of 4.9%.

The stability of Resin Particle Liquid Dispersion (2) was examined by the above-described method of homogenization with shear, as a result, generation of aggregation was not observed at all and the liquid dispersion was stable (A).

Example 2-3

Preparation of Resin Particle Liquid Dispersion (3)

| | |
|---|---|
| Dodecylsulfuric acid | 3.0 parts by weight |
| 1,9-Nonanediol | 80 parts by weight |
| Azelaic acid | 94 parts by weight |
| Co-Present Non-Crystalline Polycondensed Resin 1 | 261 parts by weight |

These raw materials were charged and mixed in a 3 liter-volume four-neck flask, and the mixture was melted as a viscous mixture under heating at 120° C. by a mantle heater and then kept at 120° C. for 8 hours while stirring with Three-One Motor and reducing the pressure, as a result, the contents became a more viscous melt.

An aqueous solution for neutralization prepared by dissolving 2.0 parts by weight of an aqueous 1N NaOH solution in 1,740 parts by weight of ion exchanged water heated at 90° C. was charged into the flask and after emulsification in a homogenizer (ULTRA-TURRAX, manufactured by IKA Works, Inc.) for 15 minutes and further in an ultrasonic bath under heating at 90° C. for 5 minutes, the flask was cooled in water at room temperature.

In this way, Crystal Non-Crystal Mixed Polyester Resin Particle Liquid Dispersion (3) was obtained, in which the median diameter of the particle was 620 nm, the melting point of the crystal resin was 52° C., the weight average molecular weight was 10,500 and the solid content was 20%.

The glass transition point of the non-crystalline resin overlapped with the melting point peak of the crystalline resin and could not be measured.

The particles of Resin Particle Liquid Dispersion (3) had a large/small particle overall ratio of 5.5%.

The stability of Resin Particle Liquid Dispersion (3) was examined by the above-described method of homogenization with shear, as a result, generation of aggregation was slightly observed but in a level of no problem (B).

Example 2-4

Preparation of Resin Particle Liquid Dispersion (4)

| | |
|---|---|
| Para-toluenesulfonic acid | 2.5 parts by weight |
| Scandium dodecylbenzenesulfonate (rare earth-containing catalyst) | 3.6 parts by weight |
| Terephthalic acid | 46 parts by weight |
| Polyoxyethylene(2,4)-2,2-bis(4-hydroxyphenyl)propane | 34 parts by weight |
| Ethylene glycol | 20 parts by weight |
| Co-Present Crystalline Polycondensed Resin 2 | 100 parts by weight |

These raw materials were mixed in a 1 liter-volume four-neck flask, and the mixture was melted under heating at 140° C. by a mantle heater and then kept at 140° C. for 10 hours while stirring with Three-One Motor and expelling the gas, as a result, the contents became a more viscous melt.

An aqueous solution for neutralization prepared by dissolving 3.0 parts by weight of an aqueous 1N NaOH solution in 425 parts by weight of ion exchanged water heated at 90° C. was charged into the flask and after emulsification in a homogenizer (ULTRA-TURRAX, manufactured by IKA Works, Inc.) for 15 minutes and further in an ultrasonic bath under heating at 90° C. for 5 minutes, the flask was cooled in water at room temperature.

In this way, Crystal-Non-Crystal Mixed Polyester Resin Particle Liquid Dispersion (4) was obtained, in which the median diameter of the particle was 240 nm, the melting point of the crystal resin was 70° C., the glass transition point of the non-crystal resin was 53° C., the total weight average molecular weight was 12,000 and the solid content was 20%.

The particles of Resin Particle Liquid Dispersion (4) had a large/small particle overall ratio of 2.8%.

The stability of Resin Particle Liquid Dispersion (4) was examined by the above-described method of homogenization with shear, as a result, generation of aggregation was slightly observed but in a level of no problem (B).

Example 2-5

Preparation of Resin Particle Liquid Dispersion (5)

| | |
|---|---|
| Dodecylbenzenesulfonic acid | 2.4 parts by weight |
| Lipase (originated in *Pseudomonas* group; enzyme catalyst) | 10 parts by weight |

-continued

| | |
|---|---|
| 1,9-Nonanediol | 80 parts by weight |
| 1,10-Decanedicarboxylic acid | 115 parts by weight |
| Co-Present Non-Crystalline Polycondensed Resin 1 | 98 parts by weight |

These raw materials were mixed in a 3 liter-volume four-neck flask according to the formulation above, and the mixture was melted under heating at 120° C. by a mantle heater and then kept at 80° C. for 10 hours while stirring with Three-One Motor and expelling the gas, as a result, the contents became a more viscous melt.

An aqueous solution for neutralization prepared by dissolving 2.0 parts by weight of an aqueous 1N NaOH solution in 1,170 parts by weight of ion exchanged water heated at 80° C. was charged into the flask and after emulsification in a homogenizer (ULTRA-TURRAX, manufactured by IKA Works, Inc.) for 15 minutes and further in an ultrasonic bath for 10 minutes, the flask was cooled in water at room temperature.

In this way, Non-Crystalline Polyester Resin Particle Liquid Dispersion (5) was obtained, in which the median diameter of the particle was 210 nm, the melting point of the crystal resin was 70° C., the glass transition point of the non-crystal resin was 54° C., the weight average molecular weight was 16,000 and the solid content was 20%.

The particles of Resin Particle Liquid Dispersion (5) had a large/small particle overall ratio of 0.9%.

The stability of Resin Particle Liquid Dispersion (5) was examined by the above-described method of homogenization with shear, as a result, generation of aggregation was not observed at all and the level was (A).

Comparative Example 2-1

Preparation of Resin Particle Liquid Dispersion (6)

| | |
|---|---|
| Dodecylbenzenesulfonic acid | 3.6 parts by weight |
| 1,9-Nonanediol | 80.0 parts by weight |
| 1,10-Decanedicarboxylic acid | 115.0 parts by weight |
| Co-Present Non-Crystalline Polycondensed Resin 1 | 195 parts by weight |

These raw materials were charged and mixed in a 3 liter-volume four-neck flask, and the mixture was melted under heating at 120° C. by a mantle heater and then kept at 90° C. for 8 hours while stirring with Three-One Motor and expelling the gas, as a result, the contents became a more viscous melt.

Thereafter, 1,580 g of ion exchanged water heated at 90° C. was charged as-is into the flask and after emulsification in a homogenizer (ULTRA-TURRAX, manufactured by IKA Works, Inc.) for 5 minutes, the flask was cooled in water at room temperature.

In this way, Crystal-Non-Crystal Mixed Polyester Resin Particle Liquid Dispersion (6) was obtained, in which the center diameter of the particle was 2,200 nm, the melting point of the crystal resin was 67° C., the glass transition point of the non-crystal resin was 54° C. and the solid content was 20%. The weight average molecular weight as a total was 12,700.

The particles of Resin Particle Liquid Dispersion (6) had a large/small particle overall ratio of 12.5%.

The stability of Resin Particle Liquid Dispersion (6) was examined by the above-described method of homogenization with shear, as a result, generation of a large amount of aggregates was observed (D).

Comparative Example 2-2

Preparation of Resin Particle Liquid Dispersion (7)

| | |
|---|---|
| Dodecylbenzenesulfonic acid | 3.6 parts by weight |
| 1,4-Butanediol | 45 parts by weight |
| Azelaic acid | 94 parts by weight |
| Co-Present Non-Crystalline Polycondensed Resin 1 | 140 parts by weight |

These raw materials were mixed in a 500 ml-volume flask according to the formulation above, and the mixture was melted under heating at 110° C. by a mantle heater and then kept at 80° C. for 8 hours while stirring with Three-One Motor and expelling the gas, as a result, the contents became a more viscous melt.

An aqueous solution for neutralization prepared by dissolving 2.0 parts by weight of an aqueous 1N NaOH solution in 1,120 parts by weight of ion exchanged water heated at 80° C. was charged into the flask and after emulsification in a homogenizer (ULTRA-TURRAX, manufactured by IKA Works, Inc.) for 30 minutes and further in an ultrasonic bath kept at 90° C. for 20 minutes, the flask was cooled in water at room temperature.

In this way, Crystalline Polyester Resin Particle Liquid Dispersion (7) was obtained, in which the median diameter of the particle was 45 nm, the melting point of the crystal resin was 48° C., the weight average molecular weight was 17,000 and the solid content was 20%.

The particles of Resin Particle Liquid Dispersion (7) had a large/small particle overall ratio of 10.5%.

The glass transition point of the non-crystal resin could not be measured.

Also, before the preparation of a toner, the stability of Resin Particle Liquid Dispersion (7) was examined by the above-described method of homogenization with shear, as a result, generation of aggregation was observed (D).

Comparative Example 2-3

Preparation of Resin Particle Liquid Dispersion (8)

In the preparation of Resin Particle Liquid Dispersion (1), Co-Present Non-Crystalline Polycondensed Resin 1 was not used and the weight of polycondensable monomer was increase to 2 times, thereby producing a resin particle liquid dispersion.

In this way, Crystal-Non-Crystal Mixed Polyester Resin Particle Liquid Dispersion (8) was obtained, in which the median diameter of the particle was 410 nm, the melting point of the crystal resin was 68° C., the glass transition point of the non-crystal resin was not obtained and the solid content was 20%. The weight average molecular weight as a total was 4,200.

The particles of Resin Particle Liquid Dispersion (8) had a large/small particle overall ratio of 6.7%.

The stability of Resin Particle Liquid Dispersion (8) was examined by a method of weighing 100 g of the resin particle liquid dispersion in a 300 ml-volume stainless steel beaker, homogenizing it with shear by IKA ULTRA-TURRAX T50 in the beaker for 1 minute, filtering the resin particle liquid dispersion through a 77-micron nylon mesh, and observing the presence or absence of generation of aggregation, as a result, generation of a large amount of aggregates was observed (D).

These results of Examples 2-1 to 2-5 and Comparative Examples 2-1 to 2-3 are shown in Table 2-1.

In the Table, the stability of the resin particle liquid dispersion was evaluated according to the following criteria:

A: absolutely no generation of aggregation;

B: slightly generated but no problem;

C: somewhat generated;

D: generation of a large amount of aggregates.

TABLE 2-1

| Resin Particle Liquid Dispersion | Polycondensable Monomer | | Co-Present Polycondensed Resin | Median Diameter of Resin Particle, μm | Melting Point of Crystal Resin, ° C. | Temperature at Melt-Mixing, ° C. | Temperature at Polycondensation, ° C. | Temperature at Emulsification Dispersion, ° C. | Stability of Resin Liquid Dispersion |
|---|---|---|---|---|---|---|---|---|---|
| Example 2-1 | 1,9-nonanediol | 1,10-decanedicarboxylic acid | Non-Crystalline Resin 1 | (1) 0.34 | (1) 68 | 120 | 90 | 90 | A |
| Example 2-2 | 1,6-hexanediol | sebacic acid | Non-Crystalline Resin 1 | (2) 0.44 | (2) 68 | 130 | 90 | 80 | A |
| Example 2-3 | 1,9-nonanediol | azelaic acid | Non-Crystalline Resin 1 | (3) 0.62 | (3) 52 | 120 | 120 | 90 | B |
| Example 2-4 | polyol A + ethylene glycol | terephthalic acid | Crystalline Resin 2 | (4) 0.24 | (4) 70 | 140 | 140 | 90 | B |
| Example 2-5 | 1,9-nonanediol | 1,10-decanedicarboxylic acid | Non-Crystalline Resin 1 | (5) 0.21 | (5) 70 | 120 | 80 | 80 | A |
| Comparative Example 2-1 | 1,9-nonanediol | 1,10-decanedicarboxylic acid | Non-Crystalline Resin 1 | (6) 2.2 | (6) 67 | 120 | 90 | 90 | D |
| Comparative Example 2-2 | 1,4-butanediol | azelaic acid | Non-Crystalline Resin 1 | (7) 0.04 | (7) 48 | 110 | 80 | 90 | D |
| Comparative Example 2-3 | 1,9-nonanediol | 1,10-decanedicarboxylic acid | None | (8) 0.41 | (8) 68 | 120 | 90 | 90 | D |

Polyol A: polyoxyethylene(2,4)-2,2-bis(4-hydroxyphenyl)propane

It is seen from the results shown in Table 2-1 that as in Examples of the present invention, when polycondensed resin particles are polycondensed at a low temperature and emulsification-dispersed simultaneously with neutralization and the median diameter thereof is within a predetermined range, the stability of the resin particle liquid dispersion is enhanced.

On the other hand, as in Comparative Examples, when polycondensed resin particles are prepared by emulsification-dispersing a polycondensed resin but the median diameter thereof is not within a predetermined range, or when the median diameter is within a predetermined range but the polycondensed resin particles are prepared by separately obtaining a polycondensed resin and dispersing it in an aqueous medium, the stability of the resin particle liquid dispersion is poor.

| (Preparation of Resin Particle Liquid Dispersion (9): Non-Crystal Vinyl-Based Resin) | |
|---|---|
| Styrene | 460 parts by weight |
| n-Butyl acrylate | 140 parts by weight |
| Acrylic acid | 12 parts by weight |
| Dodecanethiol | 9 parts by weight |

Respective components were mixed and dissolved according to the formulation above to prepare a solution. After 12 parts by weight of an anionic surfactant (DOWFAX, produced by Rhodia, Inc.) was dissolved in 250 parts by weight of ion exchanged water, the solution prepared above was added thereto and dispersed and emulsified in a flask (Monomer Emulsion A). Furthermore, 1 part by weight of the same anionic surfactant (DOWFAX, produced by Rhoda, Inc.) was dissolved in 555 parts by weight of ion exchanged water and the resulting solution was charged into a polymerization flask. The polymerization flask was tightly plugged and after a reflux tube was equipped, the polymerization flask was heated to 75° C. on a water bath while injecting nitrogen and slowly stirring, and then kept as-is.

Subsequently, 9 parts by weight of ammonium persulfate was dissolved in 43 parts by weight of ion exchanged water, the resulting solution was added dropwise into the polymerization flask through a metering pump over 20 minutes, and then Monomer Emulsion A was added dropwise through a metering pump over 200 minutes.

Thereafter, the polymerization flask was kept at 75° C. for 3 hours while continuing slowly stirring to complete the polymerization.

In this way, Anionic Resin Particle Liquid Dispersion (9) was obtained, in which the median diameter of the particle was 210 nm, the glass transition point was 53.5° C., the weight average molecular weight was 31,000 and the solid content was 42%.

The particles of Resin Particle Liquid Dispersion (9) had a large/small particle overall ratio of 0.2%.

| (Preparation of Colorant Particle Liquid Dispersion (1)) | |
|---|---|
| Yellow pigment (Y74, produced by Dainichiseika Colour & Chemicals Mfg. Co., Ltd.) | 50 parts by weight |
| Anionic surfactant (NEOGEN R, produced by Dai-ichi Kogyo Seiyaku Co., Ltd.) | 5 parts by weight |
| Ion exchanged water | 200 parts by weight |

These components were mixed and dissolved according to the formulation above, and the resulting solution was dispersed by a homogenizer (ULTRA-TURRAX, manufactured by IKA Works, Inc.) for 5 minutes and further by an ultrasonic bath for 10 minutes to obtain Yellow Colorant Particle Liquid Dispersion (1) having a center diameter (median diameter) of 240 nm and a solid content of 21.5%.

Preparation of Colorant Particle Liquid Dispersion (2)

Cyan Colorant Particle Liquid Dispersion (2) having a center diameter (median diameter) of 190 nm and a solid content of 21.5% was prepared in the same manner as Colorant Particle Liquid Dispersion (1) except that in the preparation of Colorant Particle Liquid Dispersion (1), a cyan pigment (Copper Phthalocyanine B15:3, produced by Dainichiseika Colour & Chemicals Mfg. Co., Ltd.) was used in place of the yellow pigment.

Preparation of Colorant Particle Liquid Dispersion (3)

Magenta Colorant Particle Liquid Dispersion (3) having a center diameter (median diameter) of 165 nm and a solid content of 21.5% was prepared in the same manner as Colorant Particle Liquid Dispersion (1) except that in the preparation of Colorant Particle Liquid Dispersion (1), a magenta pigment (PR122, produced by Dai-Nippon Ink & Chemicals, Inc.) was used in place of the yellow pigment.

Preparation of Colorant Particle Liquid Dispersion (4)

Black Colorant Particle Liquid Dispersion (4) having a center diameter (median diameter) of 170 nm and a solid content of 21.5% was prepared in the same manner as Colorant Particle Liquid Dispersion (1) except that in the preparation of Colorant Particle Liquid Dispersion (1), a black pigment (carbon black, produced by Cabot, Inc.) was used in place of the yellow pigment.

| (Preparation of Releasing Agent Particle Liquid Dispersion) | |
|---|---|
| Paraffin wax (HNP9, produced by Nippon Seiro Co., Ltd.; melting point: 70° C.) | 50 parts by weight |
| Anionic surfactant (DOWFAX, produced by Rhodia, Inc.) | 5 parts by weight |
| Ion exchanged water | 200 parts by weight |

The components according to the formulation above were heated to 95° C. and after thorough dispersion by a homogenizer (ULTRA-TURRAX T50, manufactured by IKA Works, Inc.), subjected to a dispersion treatment in a pressure jet-type homogenizer (GAULIN HOMOGENIZER, manufactured by Gaulin Corp.) to obtain a releasing agent particle liquid dispersion having a center diameter (median diameter) of 180 nm and a solid content of 21.5%.

Toner Example 2-6

| (Preparation of Toner Particle) | |
|---|---|
| Resin Particle Liquid Dispersion (1) | 210 parts by weight (resin: 42 parts by weight) |
| Resin Particle Liquid Dispersion (1) | 105 parts by weight (resin: 21 parts by weight): for additional addition |
| Colorant Particle Liquid Dispersion (1) | 40 parts by weight (colorant: 8.6 parts by weight) |
| Releasing Agent Particle Liquid Dispersion | 40 parts by weight (releasing agent: 8.6 parts by weight) |
| Polyaluminum chloride | 0.15 parts by weight |
| Ion exchanged water | 300 parts by weight |

The components (excluding Resin Particle Liquid Dispersion (1) for additional addition) according to the formulation above were thoroughly mixed and dispersed in a round stainless steel-made flask by a homogenizer (ULTRA-TURRAX T50, manufactured by IKA Works, Inc.) and after the flask was heated to 40° C. over a heating oil bath while stirring and then kept at 40° C. for 60 minutes, 105 parts by weight (resin: 21 parts by weight) of Resin Particle Liquid Dispersion (1) was additionally added and gently stirred.

Thereafter, the pH in the system was adjusted to 6.0 with 0.5 mol/liter of an aqueous sodium hydroxide solution, and then the system was heated to 85° C. while continuing stirring. In the time period of elevating the temperature to 85° C., the pH in the system usually decreases to 5.0 or less but here, the pH was kept not to decrease to 5.5 or less by additionally adding dropwise the aqueous sodium hydroxide solution.

After the completion of reaction, the reaction solution was cooled, filtrated, thoroughly washed with ion exchanged water and then subjected to solid-liquid separation by Nutsche suction filtration. The solid portion was again dispersed in 3 liter of ion exchanged water at 40° C., and then washed by stirring for 15 minutes at 300 rpm. This washing operation was repeated five times. Subsequently, the resulting solution was subjected to solid-liquid separation by Nutsche suction filtration, and the solid portion was vacuum-dried for 12 hours to obtain toner particles.

The particle diameter of the obtained toner particle was measured by a COULTER COUNTER, as a result, the accumulated volume average particle diameter $D_{50}$ was 4.5 μm, and the volume average particle size distribution index GSDv was 1.20. Also, the shape factor SF1 of the toner particle was determined by the observation of shape with a LUZEX image analyzer and found to be 128, and the particle shape was a potato-like shape.

Subsequently, 1.5 parts by weight of hydrophobic silica (TS720, produced by Cabot, Inc.) was added to 50 parts by weight of the toner particles obtained above, and mixed in a sample mill to obtain an external addition toner.

A ferrite carrier having an average particle diameter of 50 μm, which was coated with polymethyl methacrylate (produced by Soken Chemical & Engineering Co., Ltd.) to a coverage of 1%, was used as the carrier and after weighing the external addition toner to give a toner concentration of 5%, the carrier and the toner were stirred and mixed in a ball mill for 5 minutes to prepare a developer.

Evaluation of Toner

Using the developer prepared above, the fixability of the toner was examined in a modified machine of DOCUCENTER COLOR 500 manufactured by Fuji Xerox Co., Ltd., by using J coat paper produced by Fuji Xerox Co., Ltd. as the transfer sheet and adjusting the process speed to 180 mm/sec. As a result, it was confirmed that the oil-less fixability by a PFA tube fixing roll was good, the lowest fixing temperature was 110° C. or more, the image was exhibiting satisfactory fixability, and the transfer sheet was separated without any resistance. Incidentally, the lowest fixing temperature is defined as a fixing temperature where when the temperature is gradually elevated from a low temperature (usually around 70° C.) and when the image fixed is rubbed with a white gauze, staining of image or attachment of toner to the gauze does not occur.

The image quality was examined by using the above-described modified machine under the same conditions, as a result, the image obtained at a fixing temperature of 140° C. was a high-quality image (B) endowed with good surface gloss of 65%, satisfied in both developability and transferability, and free from image defects.

Furthermore, generation of hot offset was examined by gradually elevating the fixing temperature in the above-described modified machine under the same conditions, as a result, generation of hot offset was not observed even at a fixing temperature of 200° C.

Also, when a continuous printing test of 200,000 sheets was performed at 23° C.-55% RH in the above-described modified machine, the initial good image quality was maintained to the end (maintenance at continuous test: B).

Toner Example 2-7

Toner particles were obtained in the same manner as in Example 2-6 except that in Example 2-6, Resin Particle Liquid Dispersion (1) was changed to Resin Particle Liquid Dispersion (2), Colorant Particle Liquid Dispersion (1) was changed to Colorant Particle Liquid Dispersion (2), and the pH at the heating to 95° C. was kept at 5.0.

The accumulated volume average particle diameter $D_{50}$ of this toner particle was 4.20 μm, the volume average particle size distribution index GSDv was 1.21, and the particle shape was slightly spherical with a shape factor SF1 of 124.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was good, the lowest fixing temperature was 110° C. or more, the image was exhibiting satisfactory fixability, and the transfer sheet was separated without any resistance. The image obtained at a fixing temperature of 150° C. was a high-quality image (B) endowed with good surface gloss of 70%, satisfied in both developability and transferability, and free from image defects. Furthermore, generation of hot offset was not observed even at a fixing temperature of 200° C.

Also, when a continuous printing test of 200,000 sheets was performed at 23° C.-55% RH in the above-described modified machine, the initial good image quality was maintained to the end (maintenance at continuous test: B).

Toner Example 2-8

Toner particles were obtained in the same manner as in Example 2-6 except that in Example 2-6, Resin Particle Liquid Dispersion (1) was changed to Resin Particle Liquid Dispersion (3), Resin Particle Liquid Dispersion (1) for additional addition was changed to Resin Particle Liquid Dispersion (9), Colorant Particle Liquid Dispersion (2) was changed to Colorant Particle Liquid Dispersion (3), and the amount of polyaluminum chloride was changed to 0.12 parts by weight.

The accumulated volume average particle diameter $D_{50}$ of this toner particle was 4.90 μm, the volume average particle size distribution index GSDv was 1.21, and the particle shape was spherical with a shape factor SF1 of 121.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was good, the lowest fixing temperature was 105° C. or more, the image was exhibiting satisfactory fixability, and the transfer sheet was separated without any resistance. The image obtained at a fixing temperature of 150° C. was a remarkably high-quality image (B) endowed with good surface gloss of 75%, satisfied in both developability and transferability, and free from image defects. Furthermore, generation of hot offset was not observed even at a fixing temperature of 200° C.

Also, when a continuous printing test of 200,000 sheets was performed at 23° C.-55% RH in the above-described modified machine, the initial good image quality was maintained to the end (maintenance at continuous test: B).

Toner Example 2-9

Toner particles were obtained in the same manner as in Example 2-6 except that in Example 2-6, Resin Particle Liquid Dispersion (1) was changed to Resin Particle Liquid Dispersion (4) and Colorant Liquid Dispersion (1) was changed to Colorant Liquid Dispersion (4).

The accumulated volume average particle diameter $D_{50}$ of this toner particle was 3.50 μm, the volume average particle size distribution index GSDv was 1.23, and the particle shape was a potato-like shape with a shape factor SF1 of 129.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was good, the lowest fixing temperature was 115° C. or more, the image was exhibiting satisfactory fixability, and the transfer sheet was separated without any resistance. The image obtained at a fixing temperature of 150° C. was a high-quality image (B) endowed with good surface gloss of 60%, satisfied in both developability and transferability, and free from image defects. Furthermore, generation of hot offset was not observed even at a fixing temperature of 200° C.

Also, when a continuous printing test of 200,000 sheets was performed at 23° C.-55% RH in the above-described modified machine, the initial good image quality was maintained to the end (maintenance at continuous test: B).

Toner Example 2-10

Toner particles were obtained in the same manner as in Example 2-7 except that in Example 2-7, Resin Particle Liquid Dispersion (2) was changed to Resin Particle Liquid Dispersion (5).

The accumulated volume average particle diameter $D_{50}$ of this toner particle was 4.10 μm, the volume average particle size distribution index GSDv was 1.23, and the particle shape was a potato-like shape with a shape factor SF1 of 122.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was good, the lowest fixing temperature was 110° C. or more, the image was exhibiting satisfactory fixability, and the transfer sheet was separated without any resistance. The image obtained at a fixing temperature of 150° C. was a high-quality image (B) endowed with good surface gloss of 60%, satisfied in both developability and transferability, and free from image defects. Furthermore, generation of hot offset was not observed even at a fixing temperature of 200° C.

Also, when a continuous printing test of 200,000 sheets was performed at 23° C.-55% RH in the above-described modified machine, the initial good image quality was maintained to the end (maintenance at continuous test: B).

Toner Comparative Example 2-4

Toner particles were obtained in the same manner as in Example 2-7 except that in Example 2-7, Resin Particle Liquid Dispersion (2) was changed to Resin Particle Liquid Dispersion (6).

The accumulated volume average particle diameter $D_{50}$ of this toner particle was 5.70 μm, the volume average particle size distribution index GSDv was 1.33, and the particle shape was a potato-like shape with a shape factor SF1 of 138.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was good, the lowest fixing temperature was 125° C. or more, and the image was exhibiting satisfactory fixability, but the separation state of transfer sheet was bad and the sheet after fixing was corrugating or wrapping. Furthermore, generation of hot offset was observed from a fixing temperature of 140° C. Also, generation of coarse powder was observed in the toner and an image defect such as white spot was observed (D).

A continuous printing test was performed at 23° C.-55% RH in the above-described modified machine, but the white spot in the image was more worsened from the initial image quality and the evaluation was discontinued at the 4,000th sheet (maintenance at continuous test: D).

Toner Comparative Example 2-5

Toner particles were obtained in the same manner as in Example 2-7 except that in Example 2-7, Resin Particle Liquid Dispersion (2) was changed to Resin Particle Liquid Dispersion (7).

The accumulated volume average particle diameter $D_{50}$ of this toner particle was 6.20 μm, the volume average particle size distribution index GSDv was 1.29, and the particle shape was spherical with a shape factor SF1 of 123.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was not good, the lowest fixing temperature was 105° C. or more, and although the image was exhibiting satisfactory fixability, the separation state of transfer sheet was bad and the sheet after fixing was corrugating or wrapping on a fixing roll. Furthermore, generation of serious hot offset was observed from a fixing temperature of 130° C. Also, an image defect was observed and the evaluation of image was not good (D).

A continuous printing test was performed at 23° C.-55% RH in the above-described modified machine, but wrapping of the sheet after fixing was more worsened from the initial state and the evaluation was discontinued at the 300th sheet (maintenance at continuous test: E).

Toner Comparative Example 2-6

Toner particles were obtained in the same manner as in Example 2-6 except that in Example 2-6, Resin Particle Liquid Dispersion (1) was changed to Resin Particle Liquid Dispersion (8).

The accumulated volume average particle diameter $D_{50}$ of this toner particle was 4.80 μm, the volume average particle size distribution index GSDv was 1.25, and the particle shape was slightly spherical with a shape factor SF1 of 128.

An external addition toner was obtained by using this toner particle in the same manner as in Example 2-6 and a developer was further prepared therefrom. The fixability of the toner was examined in the same manner as in Example 2-6, as a result, it was confirmed that the oil-less fixability by a PFA tube fixing roll was not good, the lowest fixing temperature was 100° C. or more, and although the image was exhibiting satisfactory fixability, the separation state of transfer sheet was bad and the sheet after fixing was corrugating or wrapping on a fixing roll. Furthermore, generation of serious hot offset was observed from a fixing temperature of 180° C. Also, an image defect was slightly observed (C).

A continuous printing test was performed at 23° C.-55% RH in the above-described modified machine, but despite good initial state, image streaks due to filming on a photoreceptor were generated or wrapping of sheet after fixing occurred and the evaluation was discontinued at the 3,000th sheet (maintenance at continuous test: D).

These results of Examples 2-6 to 2-10 and Comparative Examples 2-4 to 2-6 are shown together in Table 2-2.

In the Table, the image quality was evaluated according to the following criteria:

A: very good;

B: good;

C: image defects were slightly generated;

D: many image defects were generated.

The evaluation of maintenance at continuous test was as described above in Examples and Comparative Examples.

It is seen from these results that as in Examples 1 and 2 of the present invention, when polycondensed resin particles are polycondensed at a low temperature and emulsification-dispersed simultaneously with neutralization and the median diameter thereof is within a predetermined range, not only the toner using the polycondensed resin as the raw material can be efficiently produced but also the image quality and fixing performance of the toner can be remarkably enhanced.

On the other hand, as in Comparative Examples, when polycondensed resin particles are prepared by emulsification-dispersing a polycondensed resin but the median diameter thereof is not within a predetermined range, or when the median diameter is within a predetermined range but the polycondensed resin particles are prepared by separately obtaining a polycondensed resin and dispersing it in an aqueous medium, the toner properties (hot offset temperature, image quality, maintenance at continuous test) are inferior to those in Examples of the present invention.

According to the present invention, plural species of resins are uniformly mixed in individual particles in the liquid dispersion and uneven distribution of a specific resin composition does not occur in the toner, so that a resin particle liquid dispersion having higher reliability in view of fixing property, electrostatic property and resistance against filming on a photoreceptor, and allowing for stable emulsification dispersion of resin particles with low energy in an aqueous medium can be provided. Furthermore, a production process of an electrostatic image developing toner, which can produce an electrostatic image developing toner fully satisfied in the toner properties by utilizing this liquid dispersion, and an electrostatic image developing toner obtained by the production process can be provided.

The entire disclosure of Japanese Patent Application No. 2005-146290 filed on May 19, 2005 and No. 2005-146292

TABLE 2-2

| | Toner Example | | | | | Toner Comparative Example | | |
|---|---|---|---|---|---|---|---|---|
| | 2-6 | 2-7 | 2-8 | 2-9 | 2-10 | 2-4 | 2-5 | 2-6 |
| Resin particle liquid dispersion, parts by weight | (1) 210 | (2) 210 | (3) 210 | (4) 210 | (5) 210 | (6) 210 | (7) 210 | (8) 210 |
| Resin particle liquid dispersion additionally added, parts by weight | (1) 105 | (2) 105 | (9) 105 | (4) 105 | (5) 105 | (6) 105 | (7) 105 | (8) 105 |
| Colorant liquid dispersion, parts by weight | (1) 40 | (2) 40 | (3) 40 | (4) 40 | (2) 40 | (2) 40 | (2) 40 | (1) 40 |
| Releasing agent liquid dispersion, parts by weight | 40 | 40 | 40 | 40 | 40 | 40 | 40 | 40 |
| Resin particle; median diameter, μm | (1) 0.34 | (2) 0.44 | (3) 0.62 | (4) 0.24 | (5) 0.21 | (6) 2.2 | (7) 0.04 | (8) 0.41 |
| Resin particle additionally added; median particle, μm | (1) 0.34 | (2) 0.44 | (9) 0.21 | (4) 0.24 | (5) 0.21 | (6) 2.2 | (7) 0.04 | (8) 0.41 |
| Crystalline resin; melting point, ° C. | (1) 68 | (2) 68 | (3) 52 | (4) 70 | (5) 70 | (6) 67 | (7) 48 | (8) 68 |
| Large/small particle overall ratio of resin particle liquid dispersion | (1) 4.3 | (2) 4.9 | (3) 5.5 | (4) 2.8 | (5) 0.9 | (6) 12.5 | (7) 10.5 | (8) 6.7 |
| Large/small particle overall ratio of resin particle liquid dispersion additionally added | (1) 4.3 | (2) 4.9 | (9) 0.2 | (4) 2.8 | (5) 0.9 | (6) 12.5 | (7) 10.5 | (8) 6.7 |
| Particle diameter of toner, μm | 4.50 | 4.20 | 4.90 | 3.50 | 4.10 | 5.70 | 6.20 | 4.80 |
| Shape factor of toner | 132 | 124 | 121 | 129 | 122 | 137 | 123 | 128 |
| Lowest fixing temperature, ° C. | 110 | 110 | 105 | 115 | 110 | 125 | 105 | 105 |
| Hot offset temperature, ° C. | 200 or more | 200 or more | 200 or more | 200 or more | 200 or more | 140 | 130 | 180 |
| Image quality | B | B | B | B | B | D | D | C |
| Maintenance at continuous test | B | B | B | B | B | D | E | D |

filed on May 19, 2005 including specification, claims and abstract is incorporated herein by reference in its entirety.

What is claimed is:

1. A process for producing a resin particle liquid dispersion for an electrostatic image developing toner, the process comprising:

polycondensing a polycondensable monomer by utilizing an acid having a surface activating effect as one of one or more polycondensation catalyst, so as to obtain a polycondensed resin; and dispersing the polycondensed resin in an aqueous medium to which a base is added, so as to obtain a resin particle liquid dispersion in which a median diameter of resin particles is from 0.05 to 2.0 μm.

2. The process according to claim 1, wherein the one or more polycondensation catalyst further comprises a rare earth-containing catalyst.

3. The process according to claim 1, wherein the one or more polycondensation catalyst further comprises a hydrolase.

4. The process according to claim 1, wherein an amount of the acid having a surface activating effect is from 0.01 to 5 wt % based on a total weight of the polycondensable monomer.

5. The process according to claim 1, wherein the polycondensed resin particle has an weight average molecular weight of from 1,500 to 60,000.

6. A process for producing an electrostatic image developing toner, the process comprising:

polycondensing a polycondensable monomer by utilizing an acid having a surface activating effect as one of one or more polycondensation catalyst, so as to obtain a polycondensed resin;

dispersing the polycondensed resin in an aqueous medium to which a base is added, so as to obtain a resin particle liquid dispersion in which a median diameter of resin particles is from 0.05 to 2.0 μm;

aggregating the resin particles in a liquid dispersion comprising the resin particle liquid dispersion, so as to obtain aggregate particles; and heating and thereby coalescing the aggregate particles.

7. A process for producing a resin particle liquid dispersion for an electrostatic image developing toner, the process comprising:

polycondensing a polycondensable monomer by utilizing an acid having a surface activating effect as one of one or more polycondensation catalyst in a co-presence of a polycondensed resin, so as to obtain a polycondensed resin-containing material; and dispersing the polycondensed resin-containing material in an aqueous medium, so as to obtain a resin particle liquid dispersion in which a median diameter of resin particles is from 0.05 to 2.0 μm.

8. The process according to claim 7, wherein the one or more polycondensation catalyst further comprises a rare earth-containing catalyst.

9. The process according to claim 7, wherein the one or more polycondensation catalyst further comprises a hydrolase.

10. The process according to claim 7, wherein an amount of the acid having a surface activating effect is from 0.01 to 5 wt % based on a total weight of the polycondensable monomer.

11. The process according to claim 7, wherein the polycondensed resin particle has an weight average molecular weight of from 1,500 to 60,000.

12. A process for producing an electrostatic image developing toner, the process comprising:

polycondensing a polycondensable monomer by utilizing an acid having a surface activating effect as one of one or more polycondensation catalyst in a co-presence of a polycondensed resin, so as to obtain a polycondensed resin-containing material;

dispersing the polycondensed resin-containing material in an aqueous medium, so as to obtain a resin particle liquid dispersion in which a median diameter of resin particles is from 0.05 to 2.0 μm aggregating the resin particles in a liquid dispersion comprising the resin particle liquid dispersion, so as to obtain aggregate particles; and heating and thereby coalescing the aggregate particles.

* * * * *